US011781513B2

(12) United States Patent
Tokuo et al.

(10) Patent No.: US 11,781,513 B2
(45) Date of Patent: Oct. 10, 2023

(54) DISCHARGE VALVE MECHANISM AND HIGH-PRESSURE FUEL SUPPLY PUMP INCLUDING THE SAME

(71) Applicant: HITACHI ASTEMO, LTD., Hitachinaka (JP)

(72) Inventors: Kenichiro Tokuo, Hitachinaka (JP); Hiroyuki Yamada, Hitachinaka (JP); Kiyotaka Ogura, Hitachinaka (JP); Shingo Tamura, Hitachinaka (JP); Yuto Ishizuka, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/784,560

(22) PCT Filed: Dec. 11, 2020

(86) PCT No.: PCT/JP2020/046235

§ 371 (c)(1),
(2) Date: Jun. 10, 2022

(87) PCT Pub. No.: WO2021/140829

PCT Pub. Date: Jul. 15, 2021

(65) Prior Publication Data

US 2023/0029119 A1 Jan. 26, 2023

(30) Foreign Application Priority Data

Jan. 7, 2020 (JP) ..... 2020-001045

(51) Int. Cl.
*F02M 59/46* (2006.01)
*F02M 63/00* (2006.01)

(52) U.S. Cl.
CPC ..... *F02M 59/462* (2013.01); *F02M 63/007* (2013.01); *F02M 63/0071* (2013.01);
(Continued)

(58) Field of Classification Search
None
See application file for complete search history.

(56) References Cited

U.S. PATENT DOCUMENTS 3,894,556 A * 7/1975 Pareja ..... F16K 15/044 137/543.19
4,706,705 A * 11/1987 Lee, II ..... F16K 15/044 137/454.2

(Continued)

FOREIGN PATENT DOCUMENTS

CN 205446004 U 8/2016
CN 114787497 A * 7/2022 ..... F02M 59/462

(Continued)

OTHER PUBLICATIONS

International Search Report with English translation and Written Opinion of International Patent Application No. PCT/JP2020/046235 dated Mar. 23, 2021.

(Continued)

*Primary Examiner* — Kevin R Steckbauer
(74) *Attorney, Agent, or Firm* — Foley & Lardner LLP

(57) ABSTRACT

Provided is a discharge valve mechanism capable of improving responsiveness when a discharge valve is opened, and a high-pressure fuel supply pump including the discharge valve mechanism.

13 Claims, 7 Drawing Sheets

(52) U.S. Cl.
CPC .... *F02M 63/0075* (2013.01); *F02M 63/0077* (2013.01); *F02M 63/0078* (2013.01)

(56) References Cited

U.S. PATENT DOCUMENTS

| | | | | | |
|---|---|---|---|---|---|
| 4,926,902 | A * | 5/1990 | Nakamura | F02M 59/462 | 417/296 |
| 8,397,749 | B2 * | 3/2013 | Neto | F01M 1/08 | 123/41.35 |
| 8,905,066 | B2 * | 12/2014 | Erb | F16K 17/0406 | 137/533.15 |
| 9,828,959 | B2 * | 11/2017 | Teike | F02M 59/462 | |
| 10,167,834 | B2 * | 1/2019 | Teike | F02M 63/0036 | |
| 10,808,667 | B2 * | 10/2020 | Perry | F04B 53/1002 | |
| 10,961,962 | B2 * | 3/2021 | Nemoto | F02M 63/005 | |
| 11,015,558 | B2 * | 5/2021 | Perry | F02M 59/361 | |
| 11,208,974 | B2 * | 12/2021 | Pedley | F02M 55/007 | |
| 11,248,573 | B2 * | 2/2022 | Akiyama | F02M 63/0036 | |
| 11,280,304 | B1 * | 3/2022 | Moreno | F02M 37/0029 | |
| 11,352,994 | B1 * | 6/2022 | Uckermark | F02M 59/366 | |
| 2010/0116364 | A1 * | 5/2010 | Koyama | F16K 47/10 | 137/535 |
| 2012/0285556 | A1 * | 11/2012 | Erb | F02M 37/0029 | 137/539.5 |
| 2013/0333770 | A1 * | 12/2013 | Maita | F02M 59/46 | 137/315.41 |
| 2016/0169174 | A1 * | 6/2016 | Teike | F02M 59/462 | 137/539 |
| 2017/0159629 | A1 * | 6/2017 | Teike | F02M 59/462 | |
| 2020/0102924 | A1 * | 4/2020 | Perry | F02M 63/0071 | |
| 2020/0132029 | A1 * | 4/2020 | Akiyama | F02M 59/462 | |
| 2020/0263646 | A1 * | 8/2020 | Perry | F02M 63/005 | |
| 2020/0370523 | A1 * | 11/2020 | Pedley | F02M 59/02 | |
| 2022/0381213 | A1 * | 12/2022 | Yagai | F02M 63/0036 | |
| 2023/0029119 | A1 * | 1/2023 | Tokuo | F02M 59/462 | |

FOREIGN PATENT DOCUMENTS

| | | | | |
|---|---|---|---|---|
| DE | 102013215275 | A1 * | 2/2015 | F02M 59/462 |
| DE | 102014207194 | A1 * | 10/2015 | F02M 59/462 |
| DE | 102014212631 | A1 * | 10/2015 | F02M 59/462 |
| DE | 102014212646 | A1 | 10/2015 | |
| DE | 112020005427 | T5 * | 8/2022 | F02M 59/462 |
| EP | 3135900 | A1 | 3/2017 | |
| EP | 3236061 | A1 | 10/2017 | |
| EP | 3236061 | A1 * | 10/2017 | F02M 59/462 |
| EP | 3628857 | A1 * | 4/2020 | F02M 59/462 |
| EP | 3696400 | A1 * | 8/2020 | F02M 59/027 |
| EP | 3236061 | B1 * | 8/2021 | F02M 59/462 |
| EP | 3696400 | B1 * | 8/2022 | F02M 59/027 |
| GB | 2 571 933 | A | 9/2019 | |
| JP | 5180365 | B2 * | 4/2013 | F02M 59/462 |
| JP | 2019-31977 | A | 2/2019 | |
| JP | 2019031977 | A * | 2/2019 | F02M 59/462 |
| JP | 6568871 | B2 * | 8/2019 | F02M 59/462 |
| JP | 6648237 | B2 * | 2/2020 | F02M 59/462 |
| JP | 2020125768 | A * | 8/2020 | |
| WO | WO-2010095247 | A1 * | 8/2010 | F02M 59/462 |
| WO | WO 2015/163246 | A1 | 10/2015 | |
| WO | WO-2016098482 | A1 * | 6/2016 | F02M 59/462 |
| WO | WO 2019/012970 | A1 | 1/2019 | |
| WO | WO-2019012970 | A1 * | 1/2019 | F02M 59/025 |
| WO | WO-2021140829 | A1 * | 7/2021 | F02M 59/462 |

OTHER PUBLICATIONS

Office Action issued in corresponding Chinese Patent Application No. 202080084933.7, with English Machine Translation, dated Jun. 1, 2023 (18 pages).

* cited by examiner

DISCHARGE VALVE MECHANISM AND HIGH-PRESSURE FUEL SUPPLY PUMP INCLUDING THE SAME

TECHNICAL FIELD

The present invention relates to a discharge valve mechanism and a high-pressure fuel supply pump including the same.

BACKGROUND ART

Among internal combustion engines of automobiles and the like, in a direct injection type engine in which fuel is directly injected into a combustion chamber, a high-pressure fuel supply pump for increasing a pressure of the fuel is widely used. In the high-pressure fuel supply pump, it is an important problem to manufacture the high-pressure fuel supply pump at low cost with a simple configuration at present when global development of products is being advanced. For example, a discharge valve unit constituting a part of a high-pressure fuel supply pump has been proposed that has a simple configuration including a seat member having a seat surface, a discharge valve member that comes into contact with and separates from the seat surface, a discharge valve spring that biases the discharge valve member toward the seat surface side, and a valve housing that accommodates these three members (see, for example, PTL 1).

In the high-pressure fuel supply pump described in PTL 1, in order to suppress severe displacement of a valve in an intersecting direction of a stroke axis at the time of valve opening/closing, a valve housing of the discharge valve unit has a regulating portion that slidably holds a maximum diameter position of the discharge valve member, and holds the seat member on an inner diameter side such that the central axis of the seat surface of the seat member overlaps the stroke axis of the discharge valve member, and the discharge valve unit is press-fitted and fixed to an inner peripheral surface of an opening connected to the discharge valve unit formed in a pump housing in a state of being unitized by holding the discharge valve member and the seat member.

CITATION LIST

Patent Literature

PTL 1: JP 2019-31977 A

SUMMARY OF INVENTION

Technical Problem

In the discharge valve unit of the high-pressure fuel supply pump described in PTL 1, a valve housing discharge hole (passage) is provided in a portion (discharge-side distal end portion) on the discharge port side in the extending direction of the stroke axis in the valve housing, and the discharge valve member moves along the regulating portion by the fuel differential pressure between the front and rear on the stroke axis of the discharge valve member (a space on a pressurizing chamber side and a space on a discharge port side of the high-pressure fuel supply pump) to open the valve. When the discharge valve member is opened, the fuel in the pressurizing chamber passes through the valve housing discharge hole (passage) provided in a portion on an upstream side of the regulating portion or in a middle portion of the regulating portion in the side surface portion of the valve housing and is pressure-fed to a discharge port.

In the discharge valve unit having such a structure, when the differential pressure of fuel before and after the discharge valve member on the stroke axis is not sufficient when the discharge valve member is opened, there is a concern that a necessary lift amount of the discharge valve member cannot be secured and the valve opening operation becomes slow. When the lift amount at the time of opening the discharge valve member is small and the valve opening operation is slow when the high-pressure fuel supply pump operates at a large flow rate or at a high speed, the pressure in the pressurizing chamber increases more than necessary. In this case, there is a possibility that a high pressure load more than necessary is applied to various components constituting the high-pressure fuel supply pump or efficiency of the high-pressure fuel supply pump is reduced.

In the high-pressure fuel supply pump described in PTL 1, the discharge port of the pump is located in the extending direction of the stroke axis of the discharge valve unit. However, some high-pressure fuel supply pumps have a structure in which the discharge port is not provided in the extending direction of the stroke axis of the discharge valve unit but is provided at a position shifted from the discharge valve unit. In such a structure, even when the valve housing discharge hole is provided in the extending direction of the stroke axis in the valve housing as in the discharge valve unit described in PTL 1, the pressure on the discharge port side cannot be guided. Therefore, a structure for preventing the flow of fuel through the valve housing discharge hole is usually provided. In the discharge valve unit having such a structure, the fuel pressure on the secondary side of the discharge valve member in the valve housing increases as the discharge valve member moves on the stroke axis at the time of valve opening. Therefore, it is particularly difficult to sufficiently secure the fuel differential pressure before and after the stroke axis of the discharge valve member.

The present invention has been made to solve the above problems, and an object thereof is to provide a discharge valve mechanism capable of improving responsiveness when a discharge valve is opened, and a high-pressure fuel supply pump including the discharge valve mechanism.

Solution to Problem

The present application includes a plurality of means for solving the above problems, and according to an example thereof, there is provided a discharge valve mechanism including: a valve seat portion which has a primary-side flow path; a valve body which seats on and separates from the valve seat portion; and a guide portion which is formed so as to be slidable on an outer surface of the valve body and guides movement of the valve body in a contacting/separating direction with respect to the valve seat portion, in which the guide portion includes a portion in which a gap from an outer surface of the valve body is set to a predetermined value or less, a first secondary-side flow path which allows an internal space on an upstream side of the guide portion to communicate with an external flow path is formed so as to allow a fluid to flow out to a side in a moving direction of the valve body, and a second secondary-side flow path which allows an internal space on a downstream side of the guide portion to communicate with the external flow path is formed so as to allow a fluid to flow out to the side in the moving direction of the valve body.

Advantageous Effects of Invention

According to the present invention, since a guide portion functions as a flow throttle to cause a pressure drop of a fluid, a fluid differential pressure between front and rear internal spaces (internal space on upstream side and internal space on downstream side of guide portion) in a moving direction of a valve body further increases accordingly. Therefore, since a valve opening operation of the valve body becomes faster due to the increased fluid differential pressure, responsiveness of a discharge valve mechanism at the time of valve opening can be improved.

Problems, configurations, and effects other than the above will be clarified by the following description of embodiments.

DESCRIPTION OF EMBODIMENTS

Hereinafter, embodiments of a discharge valve mechanism of the present invention and a high-pressure supply fuel pump including the discharge valve mechanism will be described with reference to the drawings.

First Embodiment

Figure 1:
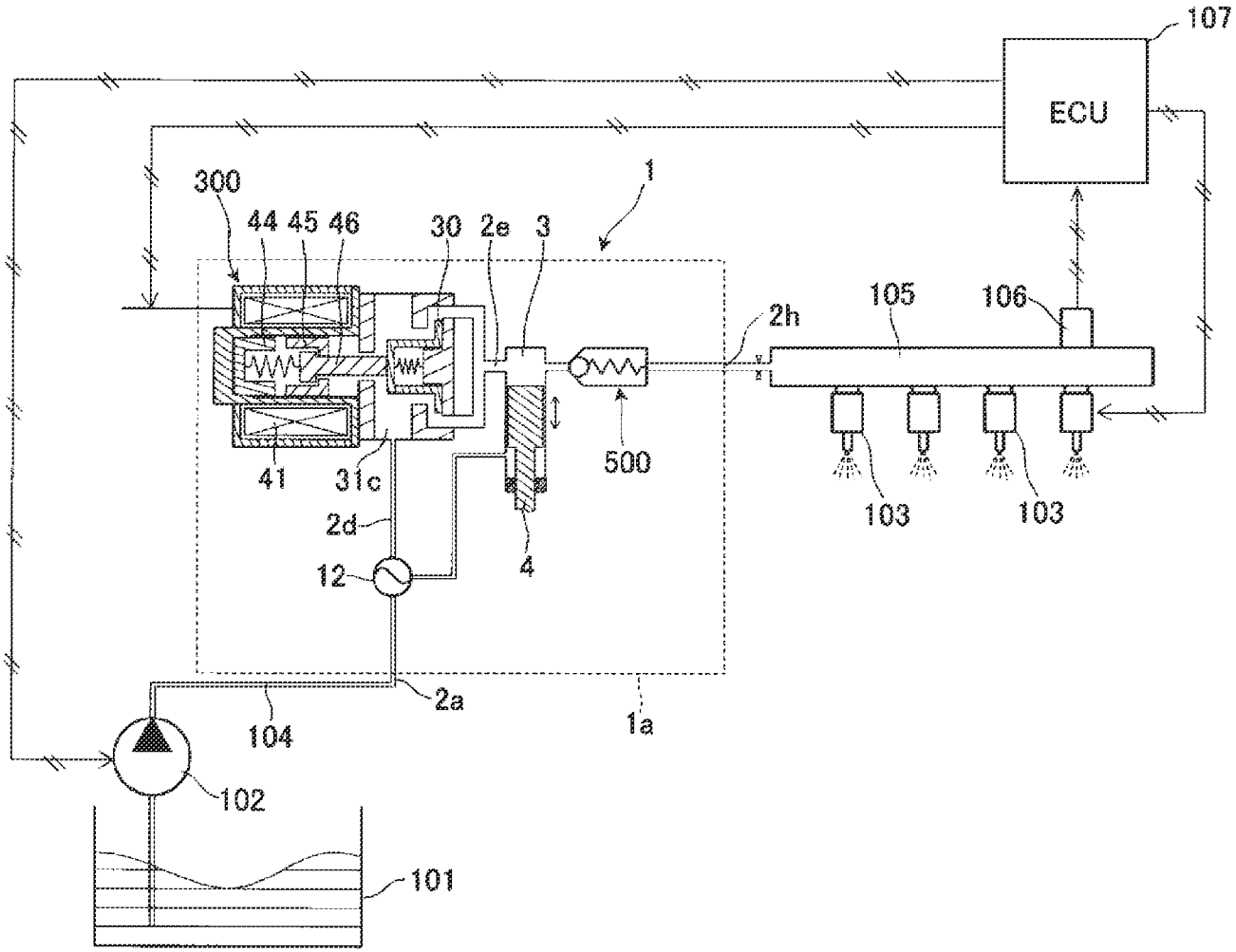
FIG. 1 is a configuration diagram illustrating a fuel supply system of an internal combustion engine including a high-pressure fuel supply pump according to a first embodiment of the present invention.

First, a configuration of a fuel supply system of an internal combustion engine including a high-pressure fuel supply pump according to a first embodiment of the present invention will be described with reference to FIG. 1. FIG. 1 is a configuration diagram illustrating the fuel supply system of the internal combustion engine including the high-pressure fuel supply pump according to the first embodiment of the present invention.

In FIG. 1, a portion surrounded by broken lines indicates a pump body which is a main body of the high-pressure fuel supply pump. Mechanisms and parts shown in the broken lines indicate that they are incorporated in the pump body. FIG. 1 is a diagram schematically illustrating the configuration of the fuel supply system, and the configuration of the high-pressure fuel supply pump illustrated in FIG. 1 is different from the configuration illustrated in FIG. 2 and subsequent drawings described later.

In FIG. 1, the fuel supply system of the internal combustion engine includes, for example, a fuel tank 101 that stores fuel, a feed pump 102 that pumps up and delivers the fuel in the fuel tank 101, a high-pressure fuel supply pump 1 that pressurizes and discharges the fuel delivered from the feed pump 102, and a plurality of injectors 103 that injects high-pressure fuel pressure-fed from the high-pressure fuel supply pump 1. The high-pressure fuel supply pump 1 is connected to the feed pump 102 via a suction pipe 104 and is connected to the injectors 103 via a common rail 105. The injector 103 is mounted on the common rail 105 according to the number of cylinders of the engine. A pressure sensor 106 that detects the pressure of the fuel discharged from the high-pressure fuel supply pump 1 is attached to the common rail 105. The present system is a system that injects fuel directly into a cylinder of an engine, a so-called direct injection engine system.

The high-pressure fuel supply pump 1 includes a pump body 1*a* having a pressurizing chamber 3 for pressurizing fuel therein, a plunger 4 assembled to the pump body 1*a*, an electromagnetic suction valve mechanism 300, and a discharge valve mechanism 500. The plunger 4 pressurizes the fuel in the pressurizing chamber 3 by a reciprocating movement. The electromagnetic valve mechanism 300 functions as a variable capacity mechanism that adjusts a flow rate of fuel sucked into the pressurizing chamber 3. The discharge valve mechanism 500 discharges the fuel pressurized by the plunger 4 toward the common rail 105. On an upstream side of the electromagnetic valve mechanism 300, a damper 12 is provided as a pressure pulsation reduction mechanism that reduces pressure pulsation generated in the high-pressure fuel supply pump 1 from spreading to the suction pipe 104.

The feed pump 102, the electromagnetic valve mechanism 300 of the high-pressure fuel supply pump 1, and the injector 103 are electrically connected to an engine control unit (hereinafter, referred to as ECU) 107, and are controlled by a control signal output from the ECU 107. A detection signal from the pressure sensor 106 is input to the ECU 107.

In the fuel supply system, the fuel in the fuel tank 101 is pumped up by the feed pump 102 driven based on a control signal of the ECU 107. This fuel is pressurized to an appropriate feed pressure by the feed pump 102 and sent to a low-pressure fuel suction port 2*a* of the high-pressure fuel supply pump 1 through the suction pipe 104. The fuel that has passed through the low-pressure fuel suction port 2*a* reaches a suction port 31*c* of the electromagnetic valve mechanism 300 via the damper 12 and a suction passage 2*d*. The fuel flowing into the electromagnetic valve mechanism 300 passes through an opening portion opened and closed by a suction valve 30. This fuel is sucked into the pressurizing chamber 3 in a downward stroke of the reciprocating plunger 4, and is pressurized in the pressurizing chamber 3 in an upward stroke of the plunger 4. The pressurized fuel is pressure-fed to the common rail 105 via the discharge valve mechanism 500. The high-pressure fuel in the common rail 105 is injected into each cylinder of the engine by each injector 103 driven based on a control signal of the ECU 107. The high-pressure fuel supply pump 1 discharges a fuel having a desired fuel flow rate according to a control signal from the ECU 107 to the electromagnetic valve mechanism 300.

Figure 2:
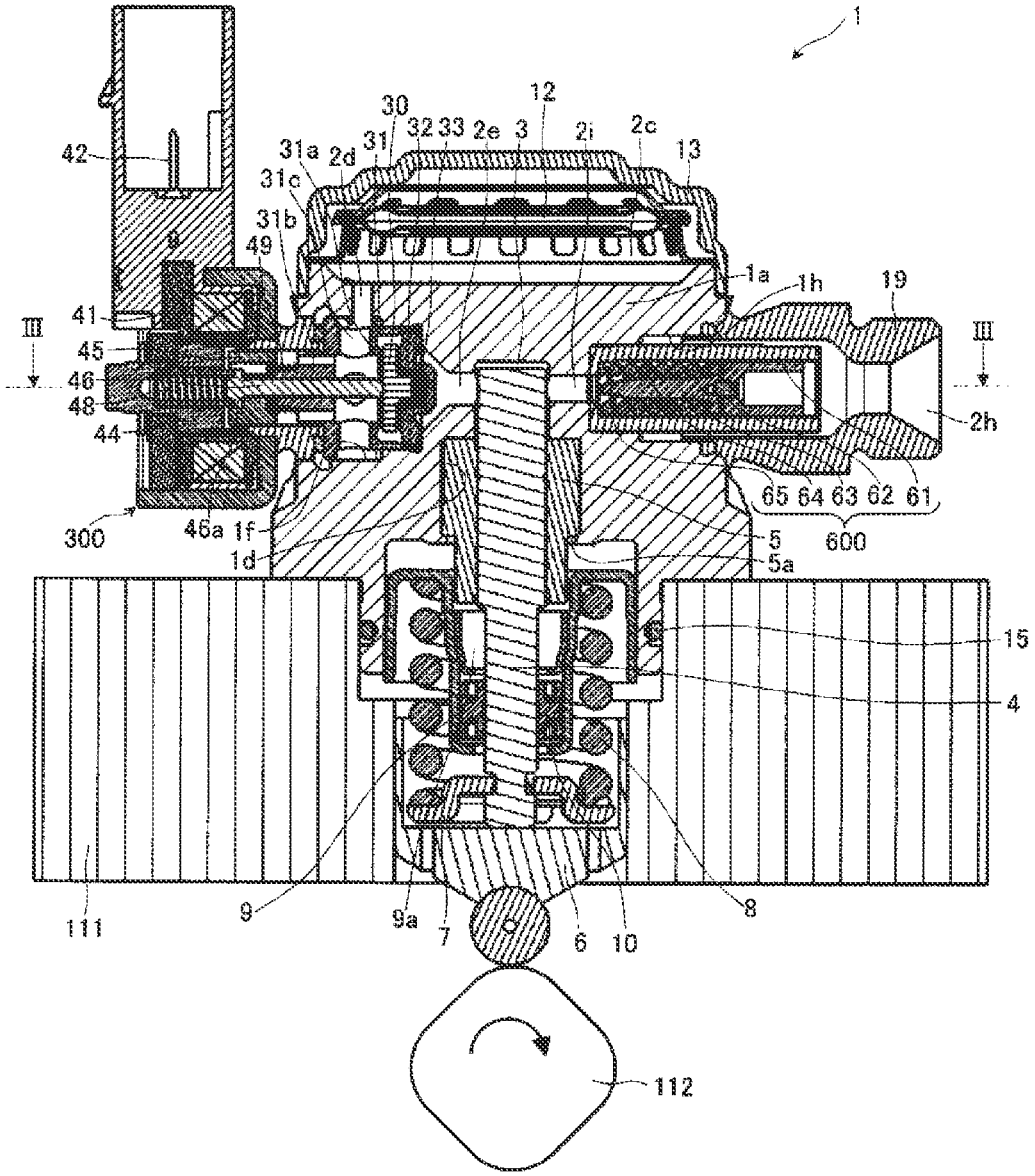
FIG. 2 is a longitudinal sectional view illustrating the high-pressure fuel supply pump according to the first embodiment of the present invention.
Figure 3:
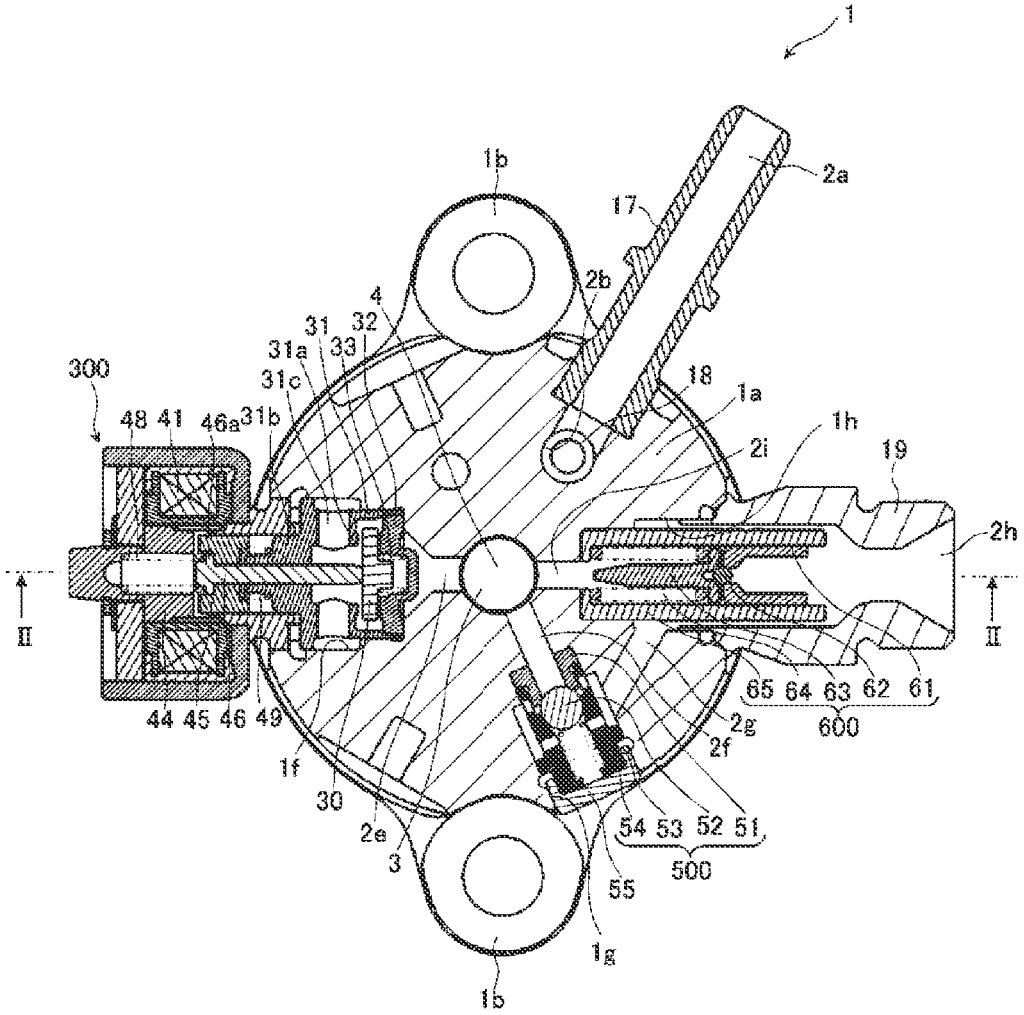
FIG. 3 is a transverse sectional view of the high-pressure fuel supply pump according to the first embodiment of the present invention illustrated in FIG. 2 as viewed from the direction of arrows III-III.

Next, a configuration of each part of the high-pressure fuel supply pump according to the first embodiment of the present invention will be described with reference to FIGS. 2 and 3. FIG. 2 is a longitudinal sectional view illustrating the high-pressure fuel supply pump according to the first embodiment of the present invention. FIG. 3 is a transverse sectional view of the high-pressure fuel supply pump according to the first embodiment of the present invention illustrated in FIG. 2 as viewed from the direction of arrows III-III.

In FIGS. 2 and 3, the high-pressure fuel supply pump 1 includes the pump body 1*a* having the pressurizing chamber 3 for pressurizing fuel therein, the plunger 4 assembled to the pump body 1*a*, the electromagnetic valve mechanism 300, the discharge valve mechanism 500 (shown only in FIG. 3), a relief valve mechanism 600, and the damper 12 (shown only in FIG. 2) as the pressure pulsation reduction mechanism. The high-pressure fuel supply pump 1 is in close contact with a pump attachment portion 111 (shown only in FIG. 2) of the engine using an attachment flange 1*b* (shown only in FIG. 3) provided in the pump body 1*a*, and is fixed by a plurality of bolts (not shown). An O-ring 15 (shown in FIG. 2) is fitted into an outer peripheral surface of the pump body 1*a* fitted to the pump attachment portion 111. The O-ring 15 seals between the pump attachment portion 111 and the pump body 1*a* to prevent engine oil or the like from leaking to the outside of the engine.

An insertion hole 1*d* extending in a longitudinal direction (In FIG. 2, an up-down direction) is formed in a central portion of the pump body 1*a*, and the cylinder 5 is press-fitted and attached to the insertion hole 1*d*. The cylinder 5 guides the reciprocating movement of the plunger 4, and forms a part of the pressurizing chamber 3 together with the pump body 1*a*. The cylinder 5 has a stepped fixing portion 5*a* on the outer peripheral portion. An opening edge of the insertion hole 1*d* of the pump body 1 is deformed toward the inner peripheral side to press the fixing portion 5*a* of the cylinder 5 toward the pressurizing chamber 3 side. As a result, an end surface of the cylinder 5 on the pressurizing chamber 3 side is pressed against a bottom surface of the insertion hole 1*d* of the pump body 1*a*, and the fuel pressurized in the pressurizing chamber 3 is sealed so as not to leak to the low pressure side.

A tappet 6 is provided on a distal end side (lower end side in FIG. 2) of the plunger 4. The tappet 6 converts a rotational movement of a cam 112 attached to a cam shaft (not illustrated) of the engine into a linear reciprocating movement and transmits the linear reciprocating motion to the plunger 4. The plunger 4 is crimped to the tappet 6 by a biasing force of a spring 8 via a retainer 7. As a result, the plunger 4 reciprocates in the cylinder 5 with the rotational movement of the cam 112, and the volume of the pressurizing chamber 3 increases or decreases.

A seal holder 9 having a bottomed tubular portion is fixed to the pump body 1*a*, and the plunger 4 penetrates the bottom portion of the seal holder 9. An auxiliary chamber 9*a* for storing fuel leaking from the pressurizing chamber 3 via a sliding portion between the plunger 4 and the cylinder 5 is formed inside the seal holder 9.

A plunger seal 10 is held on the bottom portion side (lower end portion side in FIG. 2) inside the seal holder 9. The plunger seal 10 is installed so that the outer peripheral surface of the plunger 4 is in slidable contact. The plunger seal 10 prevents the fuel in the auxiliary chamber 9 a from flowing out to the engine side during the reciprocating movement of the plunger 4. At the same time, a lubricating oil (including engine oil) in the engine is prevented from flowing into the pump body 1*a* from the engine side.

As illustrated in FIG. 3, a suction joint 17 is attached to a side wall of the pump body 1*a*. The suction pipe 104 (see FIG. 1) is connected to the suction joint 17, and fuel from the fuel tank 101 (see FIG. 1) is supplied to the inside of the high-pressure fuel supply pump 1 through the low-pressure fuel suction port 2*a* of the suction joint 17. A suction filter is disposed in the suction passage 2*b* immediately downstream of the low-pressure fuel suction port 2*a* provided in the pump body 1*a*. The suction filter 18 serves to prevent foreign matters existing between the fuel tank 101 and the low-pressure fuel suction port 2*a* from being absorbed into the high-pressure fuel supply pump 1 by the flow of fuel.

As illustrated in FIG. 2, a cup-shaped damper cover 13 is attached to a distal end portion (In FIG. 2, the upper end portion) of the pump body 1*a*. The low-pressure fuel chamber 2*c* is formed by the distal end portion of the pump body 1*a* and the damper cover 13. The damper 12 serving as a pressure pulsation reduction mechanism is disposed in the low-pressure fuel chamber 2*c*.

As illustrated in FIGS. 2 and 3, a first attachment hole 1*f* communicating with the pressurizing chamber 3 via the suction passage 2*e* formed in the pump body 1*a* is provided in a side wall of the pump body 1*a*. The electromagnetic suction valve mechanism 300 is attached to the first attachment hole 1*f*. The electromagnetic suction valve mechanism 300 is roughly divided into a valve mechanism unit including the suction valve 30 and a solenoid mechanism unit including an electromagnetic coil 41, an anchor 45, and a rod 46.

The valve mechanism unit includes, for example, the suction valve 30, a suction valve housing 31, a suction valve stopper 32, and a suction valve biasing spring 33. In the suction valve housing 31, a valve seat portion 31*a* on which the suction valve 30 is seated or separated and a rod guide portion 31*b* that slidably supports the rod 46 are integrally formed. The suction valve housing 31 is provided with the plurality of suction ports 31*c* communicating with the suction passage 2*d* formed in the pump body 1*a* on the downstream side of the low-pressure fuel chamber 2*c*. The suction valve stopper 32 is fixed to the suction valve housing 31 and regulates a lift amount of the suction valve 30. A suction valve biasing spring 33 is disposed between the suction valve 30 and the suction valve stopper 32, and the suction valve biasing spring 33 biases the suction valve 30 toward the valve seat portion 31*a* (valve closing direction).

The solenoid mechanism unit includes, for example, an electromagnetic coil 41 and a connector connection terminal 42. The connector connection terminal 42 of the connector is configured such that one end side is electrically connected to the electromagnetic coil 41, and the other end side is connectable to a control line on the ECU 107 (see FIG. 1) side.

In addition, the solenoid mechanism unit includes a magnetic core 44 of the fixing portion, and the anchor 45 and the rod 46 of a movable portion. The magnetic core 44 of the fixing portion and the anchor 45 of the movable portion form a magnetic circuit around the electromagnetic coil 41. The magnetic core 44 and the anchor 45 are disposed so as to face each other, and end surfaces of the magnetic core 44 and the anchor 45 facing each other constitute a magnetic attraction surface on which a magnetic attraction force acts. The rod 46 has a distal end portion on one side (right side in FIGS. 2 and 3) that can come into contact with and separate from the suction valve 30, and has a rod flange portion 46*a* at an end portion on the other side (left side in FIGS. 2 and 3). The rod 46 is slidably held on the inner peripheral side of the rod guide portion 31*b* and the inner peripheral side of the anchor 45, and the reciprocating motion of the rod 46 is guided by the rod guide portion 31*b*.

A rod biasing spring 48 is disposed between the magnetic core 44 and the rod flange portion 46*a*. The rod biasing spring 48 applies a biasing force in the valve opening direction of the suction valve 30. An anchor biasing spring 49 is disposed between the rod guide portion 31*b* of the suction valve housing 31 and the anchor 45. The anchor biasing spring 49 biases the anchor 45 toward the magnetic core 44 side. The rod biasing spring 48 is set to have a biasing force necessary and sufficient for maintaining the opening of the suction valve 30 in the non-energized state of the coil 34 with respect to the anchor biasing spring 49.

As illustrated in FIG. 3, a second attachment hole 1*g* is provided in a side wall of the pump body 1*a*. The discharge valve mechanism 500 is attached to the second attachment hole 1*g*. The discharge valve mechanism 500 includes, for example, a discharge valve seat 51, a valve body 52 that can be seated on and separated from the discharge valve seat 51, a discharge valve spring 53 that biases the valve body 52 toward the discharge valve seat 51, and a discharge valve holder 54 that houses the valve body 52 and the discharge valve spring 53. In the opening portion of the second attachment hole 1*g*, a plug 55 that closes the opening portion is disposed. The plug 55 is joined to the pump body 1*a* by welding or the like, and has a function of preventing fuel from leaking to the outside. The second attachment hole 1*g* in which the discharge valve mechanism 500 is disposed communicates with the pressurizing chamber 3 via a discharge passage 2*f* formed in the pump body 1*a*, and communicates with a fuel discharge port 2*h* described later via a discharge passage 2*g* formed in the pump body 1*a*.

The discharge valve mechanism 500 is configured such that, in a state where there is no fuel differential pressure between the pressurizing chamber 3 (discharge passage 2*f*) and the internal space on the secondary side of the valve body 52 (internal space communicating with the discharge passage 2*g*), the valve body 52 is pressed against the discharge valve seat 51 by the biasing force of the discharge valve spring 53 to be in a valve closed state. The valve body 52 opens against the biasing force of the discharge valve spring 53 only when the fuel pressure in the pressurizing chamber 3 becomes larger than the fuel pressure in the internal space on the secondary side of the valve body 52. The discharge valve mechanism 500 having the above configuration functions as a check valve that restricts the flow direction of the fuel.

Details of the structure of the discharge valve mechanism 500 will be described later.

As illustrated in FIGS. 2 and 3, a third attachment hole 1*h* is provided on the pump body 1*a* on the side opposite to the first attachment hole if across the pressurizing chamber 3. A discharge joint 19 forming the fuel discharge port 2*h* is fixed to an opening portion of the third attachment hole 1*h*, and a relief valve mechanism 600 is disposed in a housing space formed by the third attachment hole 1*h* of the pump body 1*a* and an internal space of the discharge joint 19.

The relief valve mechanism 600 includes, for example, a relief valve seat 61, a relief valve 62 that comes into contact with and separates from the relief valve seat 61, a relief valve holder 63 that holds the relief valve 62, a relief spring 64 that biases the relief valve 62 toward the relief valve seat 61 side, and a relief valve housing 65 that encloses these members 61, 62, 63, and 64. The relief valve housing 65 also functions as a relief body forming a relief valve chamber. The relief spring 64, the relief valve holder 63, and the relief valve 62 are inserted into the relief valve housing 65 in this order, and then the relief valve seat 61 is press-fitted and fixed. One end side of the relief spring 64 abuts on the relief valve housing 65, and the other end side abuts on the relief valve holder 63.

The biasing force of the relief spring 64 acts via the relief valve holder 63 to press the relief valve seat 61, whereby the relief valve 62 blocks the flow of the fuel. The valve opening pressure of the relief valve 62 is determined by the biasing force of the relief spring 64. The relief valve mechanism 600 in the present embodiment communicates with the pressurizing chamber 3 via a relief passage 2*i* formed in the pump body 1*a*. The relief valve mechanism 600 may be configured to communicate with the low-pressure fuel chamber 2*c* and the suction passage 2*b*.

The relief valve mechanism 600 is a valve mechanism configured to operate when some problem occurs in the common rail 105 (see FIG. 1) or a member beyond the common rail 105 and the common rail has an abnormally high pressure. That is, the relief valve mechanism 600 is configured such that the relief valve 62 opens against the biasing force of the relief spring 64 when a differential pressure between the upstream side and the downstream side of the relief valve 62 exceeds a set pressure. The relief valve mechanism 600 has a function of opening the relief valve mechanism and returning the fuel to the pressurizing chamber 11, the low-pressure fuel chamber 2*c*, or the like when the pressure in the common rail 105 increases. Since the relief valve mechanism 600 in the present embodiment returns the fuel to the pressurizing chamber 3 when the relief valve mechanism is opened, it is necessary to maintain the valve closed state at a predetermined pressure or less, and the relief valve mechanism has a strong relief spring 64 for opposing the high pressure of the pressurizing chamber 3.

Next, the operation of the high-pressure fuel supply pump will be described with reference to FIGS. 2 to 3.

In the high-pressure fuel supply pump 1 illustrated in FIG. 3, the fuel flows in from the low-pressure fuel suction port 2*a* of the suction joint 17, and foreign matters in the fuel are removed by the suction filter 18. Thereafter, the fuel flowing into the low-pressure fuel chamber 2*c* illustrated in FIG. 2 is reduced in pressure pulsation by the damper 12 in the low-pressure fuel chamber 2*c*, and reaches the electromagnetic suction valve mechanism 300 via the suction passage 2*d*.

When the plunger 4 illustrated in FIG. 2 moves downward toward the cam 112 side by the rotation of the cam 112, the volume of the pressurizing chamber 3 increases, and the fuel pressure in the pressurizing chamber 3 decreases. In this case, when the fuel pressure in the pressurizing chamber 3 becomes lower than the pressure of the suction port 31*c* of the electromagnetic suction valve mechanism 300, the suction valve of the electromagnetic suction valve mechanism 300 is opened. Therefore, the fuel passes through the opening portion of the suction valve 30 and flows into the pressurizing chamber 3. This state is referred to as a suction process.

The plunger 4 turns into an upward movement after the end of the downward movement. Here, the electromagnetic coil 41 remains in the non-energized state, and no magnetic biasing force is generated. In this case, the suction valve 30 is maintained in the valve open state by the biasing force of the rod biasing spring 48. The volume of the pressurizing chamber 3 decreases with the upward movement of the plunger 4, but in a state where the suction valve 30 is opened, the fuel once sucked into the pressurizing chamber 3 is returned to the suction passage 2*d* again through the opening portion of the suction valve 30, so that the pressure in the pressurizing chamber 3 does not increase. This state is referred to as a return stroke.

In this state, when a control signal of the ECU 107 (see FIG. 1) is applied to the electromagnetic suction valve mechanism 300, a current flows through the electromagnetic coil 41 via the terminal 42. Then, a magnetic attraction force acts between the magnetic core 44 and the anchor 45, and the magnetic core 44 and the anchor 45 collide with each other on the facing magnetic attraction surface. The magnetic attraction force overcomes the biasing force of the rod biasing spring 48 to bias the anchor 45, and the anchor 45 is engaged with the rod flange portion 46*a* to move the rod 46 in a direction away from the suction valve 30.

At this time, the suction valve 30 is closed by the biasing force of the suction valve biasing spring 33 and the fluid force due to the fuel flowing into the suction passage 2*d*. By closing the suction valve 30, the fuel pressure in the pressurizing chamber 3 increases according to the upward movement of the plunger 4, and when the fuel pressure becomes equal to or higher than the pressure of the fuel discharge port 2*h*, the discharge valve 52 of the discharge valve mechanism 500 illustrated in FIG. 3 is opened. As a result, the high-pressure fuel in the pressurizing chamber 3 is discharged from the fuel discharge port 2*h* via the discharge passage 2*f*, the discharge valve mechanism 500, and the discharge passage 2*g* and supplied to the common rail 105 (see FIG. 1). This state is referred to as a discharge stroke.

That is, the upward movement of the plunger 4 from a lower start point to an upper start point illustrated in FIG. 2 includes the return stroke and the discharge stroke. The flow rate of the high-pressure fuel to be discharged can be controlled by controlling the timing of energizing the electromagnetic coil 41 of the electromagnetic suction valve mechanism 300. If the timing of energizing the electromagnetic coil 41 is advanced, the ratio of the return stroke during the upward movement of the plunger 4 decreases, and the ratio of the discharge stroke increases. That is, while the amount of fuel returned to the suction passage 2*d* decreases, the amount of fuel discharged at a high pressure increases. Meanwhile, when the energization timing is delayed, the ratio of the return stroke during the upward movement increases, and the ratio of the discharge stroke decreases. That is, while the amount of fuel returned to the suction passage 2*d* increases, the amount of fuel discharged at a high pressure decreases. The timing of energizing the electromagnetic coil 41 is controlled by a command from the ECU 107.

When the pressure of the fuel discharge port 2*h* becomes larger than the set pressure of the relief valve mechanism 600 due to some kind of failure or the like, the relief valve 62 is opened, and the abnormally high-pressure fuel is relieved to the pressurizing chamber 3 via the relief passage 2*i*.

As described above, in the high-pressure fuel supply pump 1, the amount of fuel discharged at high pressure can be controlled to an amount required by the engine by controlling the energization timing to the electromagnetic coil 41.

Incidentally, the discharge valve mechanism 500 illustrated in FIG. 3 is opened by being moved by the fuel differential pressure between the internal space of the discharge valve seat 51 on the primary side and the inside of the discharge valve holder 54 on the secondary side located in front of and behind the valve body 52 in the moving direction. When the fuel differential pressure between the primary side and the secondary side of the valve body 52 is insufficient at the time of opening the discharge valve mechanism 500, there is a concern that the necessary lift amount of the valve body 52 cannot be secured and the valve opening operation becomes slow. When the lift amount at the time of opening the valve body 52 is small and the valve opening operation is slow when the high-pressure fuel supply pump 1 operates at a large flow rate or at a high speed, the pressure in the pressurizing chamber 3 of the high-pressure fuel supply pump 1 increases more than necessary. When the lift amount of the valve body 52 is small and the operation is slow at the time of valve opening, the pressure in the pressurizing chamber 3 of the high-pressure fuel supply pump 1 increases more than necessary. In this case, there are concern that a higher pressure load than necessary may be applied to the pump body 1*a* and the tappet 6 constituting the high-pressure fuel supply pump 1, or the efficiency of the high-pressure fuel supply pump 1 may be reduced. Therefore, the discharge valve mechanism 500 according to the present embodiment has a structure capable of sufficiently securing the fuel differential pressure between the primary side and the secondary side of the valve body 52, thereby improving the responsiveness when the valve body 52 is opened.

Figure 4:
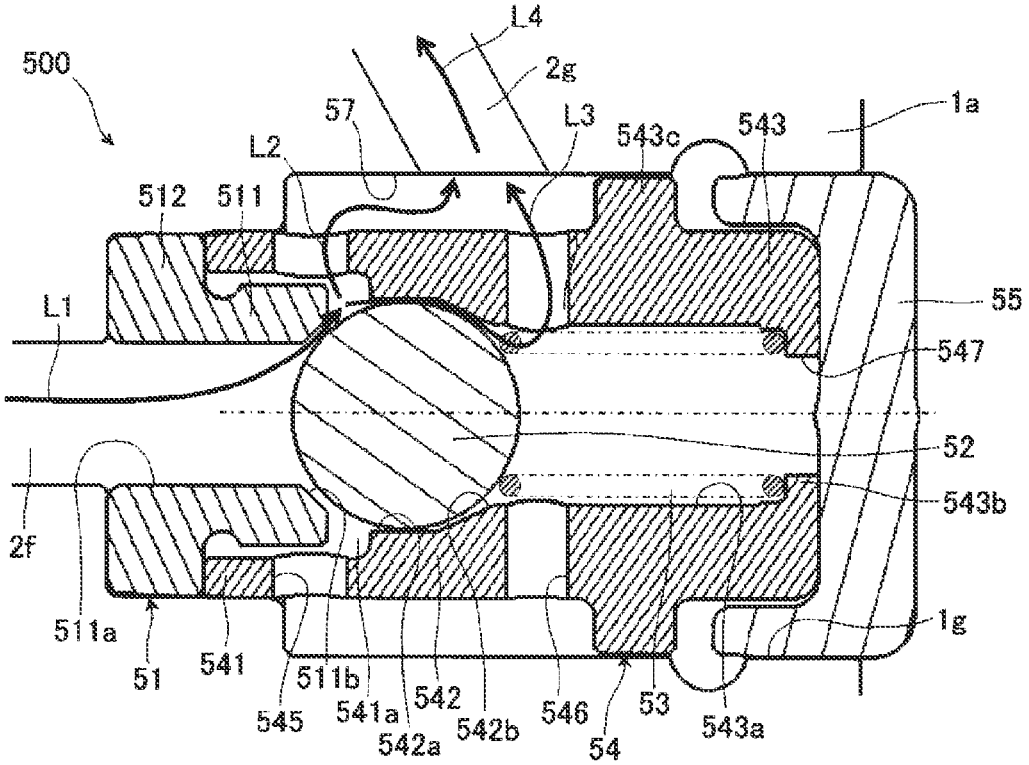
FIG. 4 is an enlarged cross-sectional view of a discharge valve mechanism according to the first embodiment of the present invention illustrated in FIG. 3.
Figure 5:
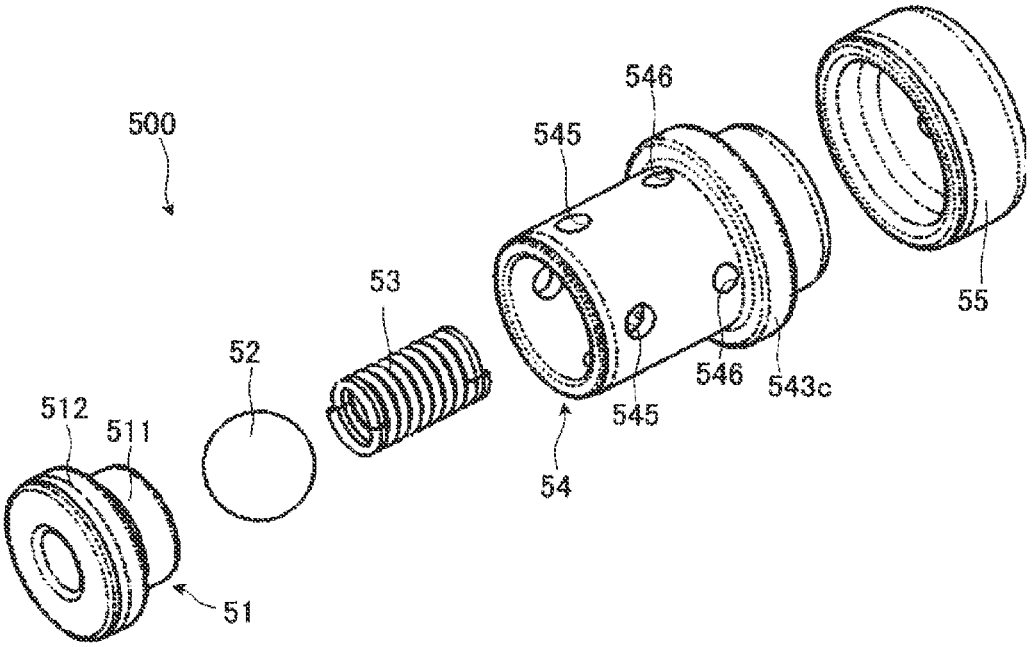
FIG. 5 is an exploded perspective view of the discharge valve mechanism according to the first embodiment of the present invention.

Next, a detailed structure of the discharge valve mechanism according to the first embodiment of the present invention will be described with reference to FIGS. 4 and 5. FIG. 4 is an enlarged cross-sectional view of the discharge valve mechanism according to the first embodiment of the present invention illustrated in FIG. 3. FIG. 5 is an exploded perspective view of the discharge valve mechanism according to the first embodiment of the present invention.

In FIGS. 4 and 5, the discharge valve mechanism 500 includes the discharge valve seat 51, the valve body 52, the discharge valve spring 53, and the discharge valve holder 54 as described above.

The discharge valve seat 51 includes a tubular seat body portion 511 whose internal space forms a primary-side flow path 511*a* of the fuel, and an annular flange portion 512 that is integrally provided on one side (left side in FIG. 4) in the axial direction of the seat body portion 511 and protrudes radially outward. The discharge valve seat 51 has a seat surface 511*b* at an opening edge of the primary-side flow path 511*a* on the other side (right side in FIG. 4) in the axial direction of the seat body portion 511. The seat surface 511*b* is configured such that the primary-side flow path 511*a* is closed by seating of the valve body 52, and is formed as, for example, a tapered surface that gradually increases in diameter toward the axial outside of the primary-side flow path 511*a*. The discharge valve seat 51 is disposed such that the flange portion 512 side faces the pressurizing chamber 3 (discharge flow path 2*f*) side, and is fixed to the pump body 1*a* by press-fitting the outer peripheral surface of the flange portion 512 into the inner peripheral surface of the second attachment hole 1*g*.

The valve body 52 is arranged on the downstream side of the primary-side flow path 511*a* of the discharge valve seat 51 in a state of being held inside the discharge valve holder 54. The valve body 52 is constituted by, for example, a ball valve capable of linear contact with the tapered seat surface 511*b* of the discharge valve seat 51.

The discharge valve spring 53 is formed of, for example, a coil spring. The discharge valve spring 53 is accommodated in the discharge valve holder 54 together with the valve body 52, and has one end side (left end side in FIG. 4) abutting on the valve body 52 and the other end side (right end side in FIG. 4) abutting on a bottom portion 543*b* described later of the discharge valve holder 54. A natural length of the discharge valve spring 53 is set to a length that allows the entire valve body 52 and discharge valve spring 53 to be accommodated in the discharge valve holder 54. As a result, the discharge valve spring 53 and the valve body 52 can be assembled after being inserted into the discharge valve holder 54 in this order, and assemblability of the discharge valve mechanism 500 is improved.

The discharge valve holder 54 is, for example, a bottomed tubular member opened on one side, and is disposed such that the opening side faces the discharge valve seat 51 side and the bottom side faces the opening side of the second attachment hole 1*g*.

The discharge valve holder 54 is configured by integrally forming, in order from the opening side toward the bottom side, a first tubular portion 541 that encloses a portion of the discharge valve seat 51 on the seat surface 511*b* side of the seat body portion 511, a second tubular portion 542 that holds the valve body 52 therein, and a third tubular portion 543 having a spring chamber 543*a* whose internal space accommodates the discharge valve spring 53 and having a bottom portion 543*b*.

For example, the first tubular portion 541 is formed such that an end surface of a distal end portion thereof abuts on an end surface of the flange portion 512 of the discharge valve seat 51 on the seat surface 511*b* side, and an outer peripheral surface of the distal end portion is press-fitted into an inner peripheral surface of the second attachment hole 1*g*. The internal space 541*a* of the first tubular portion 541 forms a flow path into which the fuel that has passed through the primary-side flow path 511*a* of the discharge valve seat 51 flows.

The second tubular portion 542 is formed with a guide portion 542*a* that guides the movement of the valve body 52 in a contacting/separating direction with respect to the discharge valve seat 51. The guide portion 542*a* is formed of an inner peripheral surface having an inner diameter slightly larger than the outer diameter of the valve body 52, and is continuous with the inner peripheral surface of the first tubular portion 541. That is, the guide portion 542*a* is formed so as to be slidable on the outer surface of the valve body 52. The gap between the guide portion 542*a* and the outer surface of the valve body 52 is set to a size that functions as a flow throttle in which a predetermined pressure drop or more occurs when the fluid passes through the gap. That is, the guide portion 542*a* is formed such that the gap from the outer surface of the valve body 52 is equal to or less than a predetermined value obtained by analysis such as simulation or experiment. The gap between the guide portion 542*a* and the valve body 52 (the internal space formed at the position of the guide portion 542*a* of the second tubular portion 542) forms a flow path located on the downstream side of the internal space 541*a* (flow path) of the first tubular portion 541.

Here, a specific example of a settable numerical range in which the gap between the guide portion 542*a* and the valve body 52 functions as a throttle will be described below. Hereinafter, a ball valve is used as the valve body 52, and the gap is obtained by subtracting the diameter of the valve body 52 from the inner diameter of the guide portion 542*a*.

First, the numerical range of the gap δ1 that functions as the throttle and is practically optimal is shown. The gap δ1 is assumed to be a case where a moving speed of the valve body 52 is 1 [m/s].

The engine displacement of a general commercially available passenger car is mostly 2 to 3 liters or less, and there is an approximate market for fuel (=discharge flow rate of fuel pump) consumed by these engines. In view of the flow rate of a general pump for a gasoline engine, for example, when a diameter d of the valve body 52 is 4.76 [mm], a gap δ1 for obtaining a desired pressure drop is 1.24 [mm]. When a tolerance is ±0.05 [mm], the lower limit of the gap δ1 is 1.19 [mm], and the upper limit thereof is 1.29 [mm]. Here, the diameter d is set to 4.76 because it is a standard of a ball diameter which is often distributed in the market, but it is not necessary to limit the diameter d to this value.

In principle, the mass of the valve body 52 is proportional to the third power of the diameter d. The differential pressure (driving force) acting on the valve body 52 is proportional to the fourth power of the valve body diameter d and inversely proportional to the square of the gap δ1. Since the acceleration is physically the driving force/mass, the acceleration of the valve body 52 is proportional to the square root (√d) of the diameter d and is inversely proportional to the square ($\delta 1^2$) of the gap δ1. As a design in which the behavior of the valve body 52 is equivalent, the diameter d and the gap δ1 may be selected so that the acceleration is equivalent. That is, the gap δ1 is proportional to the square root (√d) of the diameter d.

Based on this idea, for example, when the diameter d is 3 mm, which is relatively small for a gasoline pump, the range of the gap δ1 is as follows. The lower limit of the gap δ1 decreases in proportion to the square root (√) of the diameter of the valve body 52 and becomes 0.94 (=1.19×√(3/4.76)) [mm]. The upper limit of the gap δ1 is 1.02 (=1.29×√(3/4.76)) [mm].

The diameter d of the valve body 52 is assumed to be about 6 [mm] at the largest. In this case, the lower limit of the gap δ1 decreases in proportion to the square root (√) of the diameter of the valve body 52 and becomes 1.34 (=1.19×√(6/4.76)) [mm]. Meanwhile, the upper limit of the gap δ1 is 1.45 (=1.29×√(6/4.76)) [mm].

Although the specific example in which the moving speed of the valve body 52 is 1 m/s has been described above, it may be somewhat larger or smaller than this depending on the performance and specifications of the pump. Therefore, as a practical example, a numerical value of a gap δ2 in a case where the moving speed is 0.5 m/s and 2 m/s will be described below.

In a general equivalent velocity movement, when the average velocity is doubled, the acceleration is expected to be quadrupled. In the above description, since the acceleration of the valve body 52 is proportional to the square root (√d) of the diameter d, the gap δ2 may be ½ times. Similarly, in order to increase the acceleration by ¼, the gap δ2 may be doubled.

For example, when the diameter d of the valve body 52 is 4.7 mm and the moving speed is 2 m/s, the gap δ2 is ½ times that in the case of 1 m/s. Therefore, when the valve body diameter d is 4.76 mm, the lower limit of the gap δ2 is 1.24/2=0.62. Similarly, when the moving speed of the valve body 52 is 0.5 m/s, the gap δ2 is twice as large as that when the moving speed is 1 m/s. Therefore, when the valve body diameter d is 4.76 mm, the upper limit of the gap δ2 is 1.24×2=2.48 mm. A numerical value at such a level can function as a throttle effect for quickly moving the valve body.

When the diameter d of the valve body 52 is 3 mm, the upper limit and the lower limit of the gap δ2 are calculated as follows. The upper limit of δ2 is 1.97 (=2.48×√(3/4.76)). The lower limit of δ2 is 0.49 (=0.62×√(3/4.76)).

Similarly, when the diameter d of the valve body 52 is 6 mm, the upper limit and the lower limit of the gap δ2 are calculated as follows. The upper limit of δ2 is 2.78 (=2.48×√(6/4.76)). The lower limit of δ2 is 0.70 (=0.62×√(6/4.76)).

Figure 9:
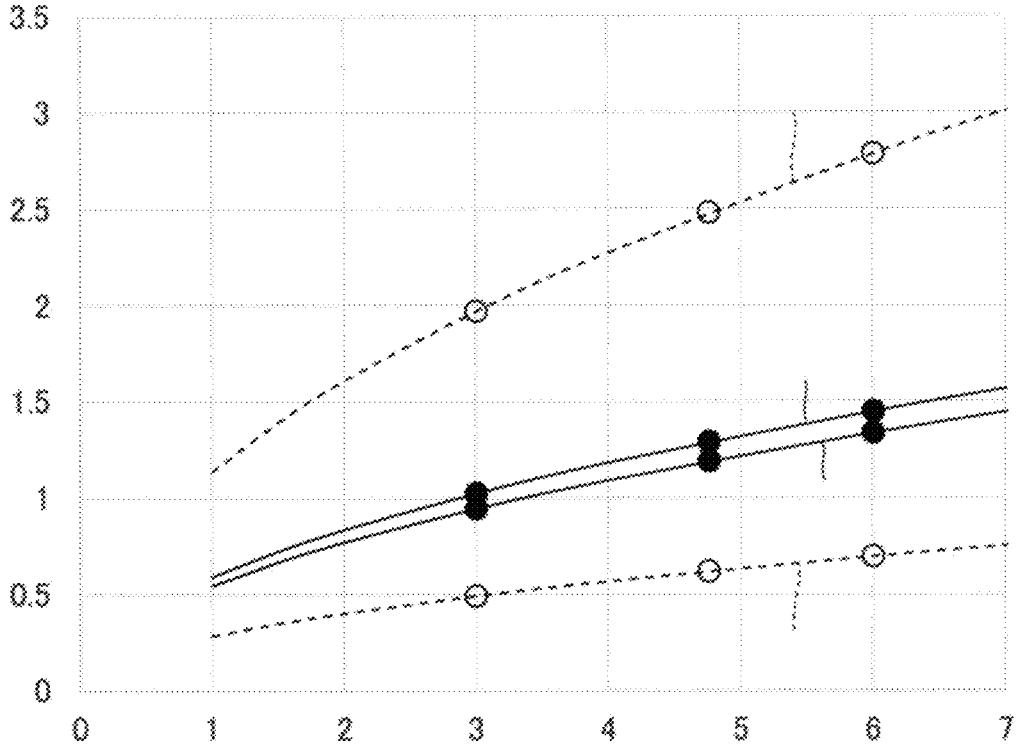
FIG. 9 is a diagram illustrating the relationship between a diameter d of the valve body 52 and gaps 61 and 62 functioning as throttles, according to an embodiment.

The relationship between the diameter d of the valve body 52 described above and the gaps 51 and 62 functioning as throttles is shown in FIG. 9 as a characteristic diagram.

The second tubular portion 542 is also formed with a stopper portion 542*b* that regulates the movement of the valve body 52 in the lift direction (valve opening direction). The stopper portion 542*b* is formed of an inner peripheral surface positioned closer to the third tubular portion 543 than the guide portion 542*a*, and is continuous with the guide portion 542*a*. The inner peripheral surface of the second tubular portion 542 constituting the stopper portion 542*b* is configured by a tapered surface whose inner diameter is smaller than the inner diameter of the guide portion 542*a* and whose diameter gradually decreases from the guide portion 542*a* side toward the third tubular portion 543 side. That is, the stopper portion 542*b* is formed so as to be able to abut on the outer surface of the valve body 52. The internal space formed at the position of the stopper portion 542*b* of the second tubular portion 542 forms a flow path on the downstream side of the internal space (flow path) formed at the position of the guide portion 542*a* and on the upstream side of the spring chamber 543*a* of the third tubular portion 543. That is, the stopper portion 542*b* is formed at a position between the guide portion 542*a* and the spring chamber 543*a*.

The inner peripheral surface of the third tubular portion 543 forming the spring chamber 543*a* is continuous with the stopper portion 542*b* of the second tubular portion 542. The spring chamber 543*a* forms a flow path located on the downstream side of an internal space (flow path) formed at the position of the stopper portion 542*b* of the second tubular portion 542. The third tubular portion 543 has an annular protruding portion 543*c* protruding radially outward from the outer peripheral surface and extending in the circumferential direction. The outer peripheral surface of the protruding portion 543*c* is press-fitted into the inner peripheral surface of the second attachment hole 1*g*.

A plurality of (for example, four in FIG. 5) first through holes 545 penetrating in the radial direction are formed in the first tubular portion 541 located closer to the discharge valve seat 51 than the guide portion 542*a* of the second tubular portion 542. As illustrated in FIG. 5, the plurality of first through holes 545 are arranged at intervals in the circumferential direction of the discharge valve holder 54. For example, the first through holes 545 are all formed to have the same hole diameter. The first through hole 545 constitutes a first secondary-side flow path that allows the internal space 541*a* of the first tubular portion 541 located on the upstream side of the guide portion 542*a* to communicate with the discharge flow path 2*g* that is an external flow path, and allows the fuel to flow out to the side (radially outside of the discharge valve holder 54) in the moving direction (contacting/separating direction) of the valve body 52.

A plurality of (for example, four in FIG. 5) second through holes 546 penetrating in the radial direction are formed in the third tubular portion 543 located at a position farther from the discharge valve seat 51 than the guide portion 542*a* and the stopper portion 542*b* of the second tubular portion 542. For example, as illustrated in FIG. 5, the plurality of second through holes 546 are arranged at intervals in the circumferential direction of the discharge valve holder 54, and are disposed so as to be aligned in the axial direction with respect to the plurality of first through holes 545. For example, the second through holes 546 are all formed to have the same hole diameter. The second through hole 546 constitutes a second secondary-side flow path that allows the spring chamber 543*a* of the third tubular portion 543 located on the downstream side of the guide portion 542*a* to communicate with the discharge flow path 2*g* that is an external flow path, and allows the fuel to flow out to the side (radially outside of the discharge valve holder 54) in the moving direction (contacting/separating direction) of the valve body 52.

The first through hole 545 and the second through hole 546 can be formed to have the same hole diameter, for example. In this case, it is not necessary to replace a drill to drill a hole at the time of processing the first through hole 545 and the second through hole 546. In addition, the hole diameter of the first through hole 545 may be set to be equal to or larger than the hole diameter of the second through hole 546. This reflects that the flow rate of the fluid flowing to the second through hole 546 through the guide portion 542*a* functioning as the throttle is relatively smaller than that of the first through hole 545 by the resistance of the throttle.

The inner surface of the bottom portion 543*b* of the third tubular portion 543 functions as a receiving seat for the discharge valve spring 53. A third through hole 547 penetrating in the axial direction is formed in the bottom portion 543*b* of the third tubular portion 543.

An annular flow path 57 is formed radially outside the discharge valve holder 54. The annular flow path 57 is formed on the outer peripheral surface of the discharge valve holder 54 and the inner peripheral surface of the second attachment hole 1*g*, and is connected to the discharge passage 2*g*. In the annular flow path 57, a first through hole 545 and a second through hole 546 of the discharge valve holder 54 are opened.

The plug 55 is inserted into the second attachment hole 1*g* separately from the discharge valve mechanism 500 and is disposed so as to be in contact with the bottom portion 543*b* of the discharge valve holder 54. Thus, the plug 55 has a function of preventing the discharge valve holder 54 from coming off.

Next, the operation and action of the discharge valve mechanism according to the first embodiment of the present invention will be described with reference to FIG. 4. In FIG. 4, thick arrows L1, L2, L3, and L4 indicate the flows of fuel, respectively.

In the discharge valve mechanism 500, the valve body 52 is pressed against the seat surface 511*b* of the discharge valve seat 51 by the biasing force of the discharge valve spring 53 to be in a valve closing state. In this state, the fuel pressurized in the compression process of the high-pressure fuel supply pump 1 is introduced from the pressurizing chamber 3 (see FIG. 3) into the discharge valve mechanism 500 through the discharge flow path 2*f*.

A pressure difference is generated between the fuel in the primary-side flow path 511*a* of the discharge valve seat 51 on the primary side of the valve body 52 and the fuel in the internal space such as the spring chamber 543*a* of the discharge valve holder 54 on the secondary side of the valve body 52. When the force generated by the fuel pressure difference becomes larger than the biasing force of the discharge valve spring 53, the lift of the valve body 52 is started. The valve body 52 is guided by the guide portion 542*a* of the discharge valve holder 54 and moves toward the stopper portion 542*b* side along the axis.

When the valve body 52 is opened, the fuel passes through the gap between the valve body 52 and the opening portion of the discharge valve seat 51 and flows into the internal space 541*a* of the first tubular portion 541 of the discharge valve holder 54 (see flow L1). A part of the fuel that has passed through the opening portion of the discharge valve seat 51 passes through the first through hole 545 of the discharge valve holder 54 and flows into the annular flow path 57 (see flow L2). Meanwhile, the rest of the fuel passes through the gap between the guide portion 542*a* of the discharge valve holder 54 and the outer surface of the valve body 52 to flow into the spring chamber 543*a* of the discharge valve holder 54, and then passes through the second through hole 546 to flow into the annular flow path 57 (see flow L3). The fuels flowing into the annular flow path 57 through the first through hole 545 and the second through hole 54 merge and pass through the discharge flow path 2*g* toward the fuel discharge port 2*h* (see FIG. 3) (see L4).

When the fuel passes through the gap between the guide portion 542*a* of the discharge valve holder 54 and the outer surface of the valve body 52 at the start of the valve opening of the valve body 52, the gap functions as a flow throttle, and thus, the pressure of the fuel flowing into the spring chamber 543*a* is lower than that of the fuel in the internal space 541*a* of the first tubular portion 541. Therefore, since a further pressure difference occurs before and after the valve body 52 in the moving direction, the force in the lift direction acting on the valve body 52 increases. As a result, since the valve opening speed (lift speed) of the valve body 52 increases, the valve body 52 can reach a large lift amount in a shorter time. That is, the responsiveness when the valve body 52 is opened is improved. By the high-speed valve opening operation of the valve body 52, the fuel in the pressurizing chamber 3 smoothly flows out without being hindered to the discharge valve mechanism side, so that it is possible to prevent an excessive pressure increase in the pressurizing chamber 3. Therefore, it is possible to improve pump efficiency and reduce a load on member strength.

Further, the fuel flowing into the annular flow path 57 through the first through hole 545 and the second through hole 546 and joined forms a swirl flow in the annular flow path 57 and then flows out to the discharge flow path 2*f*. The swirling flow in the annular flow path 57 becomes faster than the fuel flowing through the internal space 541*a* of the first tubular portion 541 and the spring chamber 543*a*, and a pressure drop occurs accordingly. In this case, the influence of the pressure drop in the annular flow path 57 reaches the spring chamber 543*a* via the second through hole 546, and the pressure in the spring chamber 543*a* further decreases. As a result, since a further pressure difference occurs before and after the valve body 52 in the moving direction, responsiveness when the valve body 52 is opened is improved.

The pressure distribution of the discharge valve mechanism 500 when the valve body 52 is opened is roughly as follows. The region where the fuel pressure is the highest is the primary-side flow path 511*a* of the discharge valve seat 51, and the region where the fuel pressure is the second highest is the internal space 541*a* (a space sandwiched between the first tubular portion 541, the seat body portion 511 of the discharge valve seat 51, and the valve body 52) of the first tubular portion 541 of the discharge valve holder 54. This is an influence of a pressure loss generated when fuel passes through a gap between the opened valve body 52 and the seat surface 511*b* of the discharge valve seat 51. A region where the fuel pressure is lower than the internal space 541*a* of the first tubular portion 541 is the spring chamber 543*a* of the discharge valve holder 54. This is an influence of a pressure drop generated when the fuel passes through the gap of the guide portion 542*a* of the discharge valve holder 54 functioning as a throttle located on the upstream side of the spring chamber 543*a*. The region where the fuel pressure is lower than that of the spring chamber 543*a* is the annular flow path 57 located on the downstream side of the first through hole 545 and the second through hole 546 of the discharge valve holder 54. This is because a pressure drop occurs as the swirl flow formed in the annular flow path 57 is faster than the flow in the internal space 541*a* of the first tubular portion 541 or the spring chamber 543*a*. As described above, the pressure distribution of the discharge valve mechanism 500 when the valve body 52 is opened decreases in the order of the primary-side flow path 511*a* of the discharge valve seat 51, the internal space 541*a* of the first tubular portion 541 of the discharge valve holder 54, the spring chamber 543*a*, and the annular flow path 57.

As described above, the discharge valve mechanism 500 according to the first embodiment of the present invention includes the discharge valve seat (valve seat portion) 51 having the primary-side flow path 511*a*, the valve body 52 capable of seating on and separating from the discharge valve seat (valve seat portion) 51, and the guide portion 542*a* that is formed to be slidable on the outer surface of the valve body 52 and guides the movement of the valve body 52 in the contacting/separating direction with respect to the discharge valve seat (valve seat portion) 51. The guide portion 542*a* includes a portion in which a gap from the outer surface of the valve body 52 is set to a predetermined value or less. The first through hole 545 as a first secondary-side flow path that allows the internal space 541*a* on the upstream side of the guide portion 542*a* to communicate with the discharge flow path (external flow path) 2*g* is formed to allow the fluid to flow out to the side in the moving direction of the valve body 52, and the second through hole 546 as a second secondary-side flow path that allows the spring chamber (internal space) 543*a* on the downstream side of the guide portion 542*a* to communicate with the discharge flow path (external flow path) 2*g* is formed to allow the fluid to flow out to the side in the moving direction of the valve body 52.

According to this configuration, since the guide portion 542*a* functions as a flow throttle to cause a pressure drop of the fluid, the fluid differential pressure between the front and rear internal spaces (the internal space 541*a* on the upstream side of the guide portion 542*a* and the internal space 543*a* on the downstream side) in the moving direction of the valve body 52 further increases accordingly. Therefore, since the valve opening operation of the valve body 52 becomes faster due to the increased fluid differential pressure, the responsiveness at the time of valve opening of the discharge valve mechanism 500 can be improved.

The discharge valve mechanism 500 according to the present embodiment further includes a stopper portion 542*b* that is formed so as to be able to abut on the outer surface of the valve body 52 and regulates the movement of the valve body 52 in the lift direction. According to this configuration, even when the fluid differential pressure between the front and rear internal spaces (the internal space 541*a* on the upstream side of the guide portion 542*a* and the internal space 543*a* on the downstream side) in the moving direction of the valve body 52 increases, the valve body 52 can be prevented from being lifted more than necessary.

In the discharge valve mechanism 500 according to the present embodiment, the stopper portion 542*b* is formed at a position between the guide portion 542*a* and the second through hole (second secondary-side flow path) 546. According to this configuration, by avoiding the stopper portion 542*b* as the formation position of the second through hole 546, it is possible to reduce the trouble of manufacturing the second through hole 546. For example, in a case where the stopper portion 542*b* is formed in a tapered shape, when the second through hole 546 is formed at the position of the stopper portion 542*b*, burrs are likely to be generated at the time of manufacturing the second through hole 546. In this case, the deburring process requires time and effort.

The discharge valve mechanism 500 according to the present embodiment includes a tubular discharge valve holder (valve holder) 54 in which the valve body 52 is held and the guide portion 542*a* is formed. According to this configuration, since the discharge valve holder 54 also serves as a guide of the valve body 52, the discharge valve mechanism 500 can be simply configured.

Further, in the discharge valve mechanism 500 according to the present embodiment, the first secondary-side flow path is configured by the first through hole 545 radially penetrating the discharge valve holder (valve holder) 54 at a position closer to the discharge valve seat (valve seat portion) 51 than the guide portion 542*a*, and the second secondary-side flow path is configured by the second through hole 546 radially penetrating the discharge valve holder (valve holder) 54 at a position farther from the discharge valve seat (valve seat portion) 51 than the guide portion 542*a*. According to this configuration, since the first through hole 545 and the second through hole 546 are formed in one discharge valve holder 54, the discharge valve mechanism 500 can be simply configured.

In the discharge valve mechanism 500 according to the present embodiment, the annular flow path 57 is formed radially outside the discharge valve holder (valve holder) 54, and each of the first through hole 545 and the second through hole 546 opens to the annular flow path 57. According to this configuration, the fuel flowing into the annular flow path 57 through the first through hole 545 and the second through hole 546 forms a swirl flow and becomes faster than the flow inside the discharge valve holder (valve holder) 54, and thus, a pressure drop occurs in the annular flow path 57 accordingly. Since the pressure drop in the annular flow path 57 is propagated to the internal space 543*a* on the downstream side of the guide portion 542*a* via the second through hole 546 and the pressure in the internal space 543*a* is reduced, a further pressure difference occurs before and after the moving direction of the valve body 52, and the responsiveness when the valve body 52 is opened is improved.

Further, in the discharge valve mechanism 500 according to the present embodiment, a plurality of first through holes 545 are formed in the circumferential direction of the discharge valve holder (valve holder) 54, and the hole diameters of the first through holes 545 are all the same. According to this configuration, it is not necessary to replace the drill at the time of processing the first through hole 545, and it is easy to manufacture the first through hole 545.

Further, in the discharge valve mechanism 500 according to the present embodiment, a plurality of second through holes 546 are formed in the circumferential direction of the discharge valve holder (valve holder) 54, and the hole diameters of the second through holes 546 are all the same. According to this configuration, it is not necessary to replace the drill at the time of processing the second through hole 546, and it is easy to manufacture the second through hole 546.

Further, in the discharge valve mechanism 500 according to the present embodiment, the first through hole 545 and the second through hole 546 are formed to have the same hole diameter. According to this configuration, it is not necessary to replace the drill at the time of machining the first through hole 545 and the second through hole 546, and it is possible to suppress an increase in man-hours in both processes of the first through hole 545 and the second through hole 546.

In the discharge valve mechanism 500 according to the present embodiment, the hole diameter of the first through hole 545 may be set to be equal to or more than the hole diameter of the second through hole 546. According to this configuration, by setting the hole diameter according to the flow rate ratio flowing through the first through hole 545 and the second through hole 546, it is possible to avoid occurrence of an excessive pressure loss in the fuel passing through the first through hole 545 and the second through hole 546, and it is possible to discharge the fuel in a high pressure state.

In addition, since the high-pressure fuel supply pump 1 according to the present embodiment includes the discharge valve mechanism 500 described above, it is possible to obtain the discharge valve mechanism 500 with improved responsiveness at the time of the valve opening.

Second Embodiment

Figure 6:
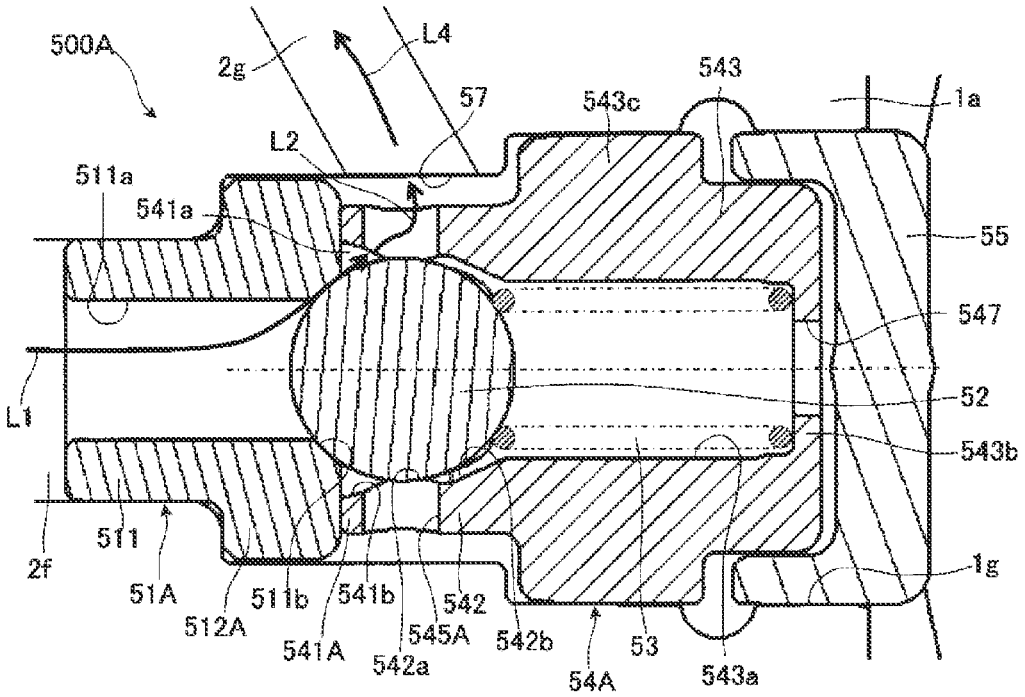
FIG. 6 is a cross-sectional view of a discharge valve mechanism according to a second embodiment of the present invention taken along a plane including a first through hole.
Figure 7:
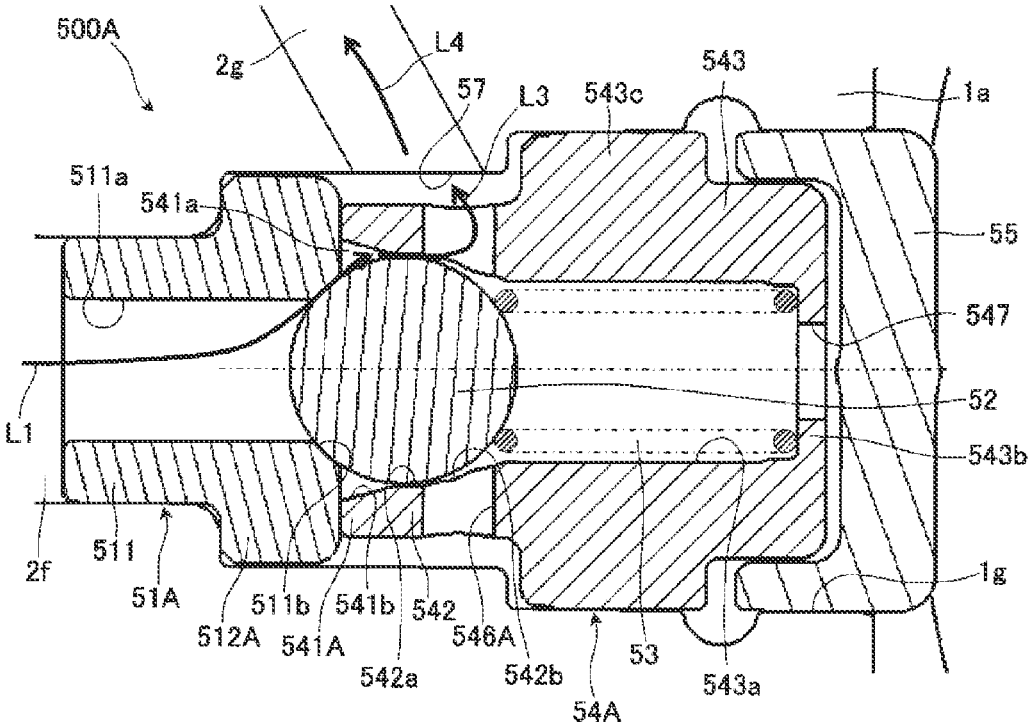
FIG. 7 is a cross-sectional view of the discharge valve mechanism according to the second embodiment of the present invention taken along a plane including a second through hole different from a cut surface illustrated in FIG. 6.
Figure 8:
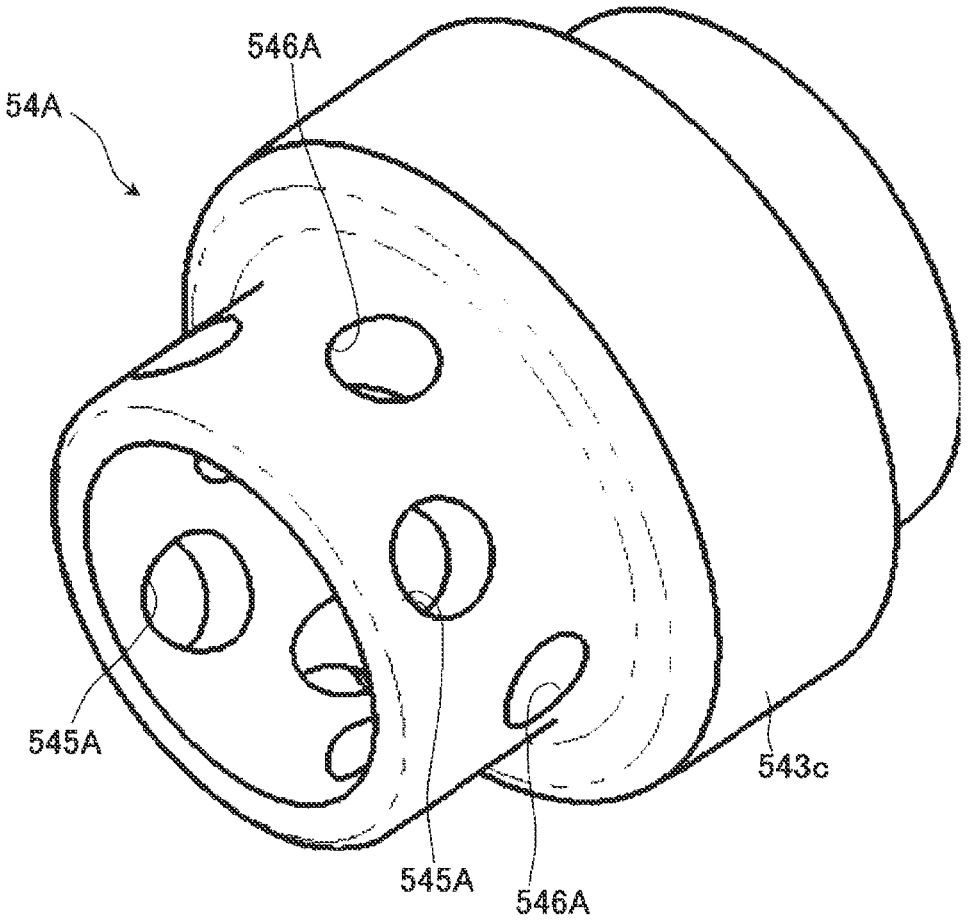
FIG. 8 is a perspective view illustrating a discharge valve holder constituting a part of a discharge valve mechanism according to a second embodiment of the present invention.

Next, configurations of a discharge valve mechanism and a high-pressure fuel supply pump including a discharge valve mechanism according to a second embodiment of the present invention will be described with reference to FIGS. 6 to 8. FIG. 6 is a cross-sectional view of a discharge valve mechanism according to a second embodiment of the present invention taken along a plane including a first through hole. FIG. 7 is a cross-sectional view of the discharge valve mechanism according to the second embodiment of the present invention taken along a plane including a second through hole different from the cut surface illustrated in FIG. 6. FIG. 8 is a perspective view illustrating a discharge valve holder constituting a part of a discharge valve mechanism according to a second embodiment of the present invention. Note that, in FIGS. 6 to 8, components having the same reference numerals as those illustrated in FIGS. 1 to 5 are similar parts, and thus a detailed description thereof will be omitted.

A discharge valve mechanism 500A according to the second embodiment of the present invention illustrated in FIGS. 6 and 7 is different from the discharge valve mechanism 500 (see FIGS. 4 and 5) according to the first embodiment in structures of a discharge valve seat 51A and a discharge valve holder 54A among the members constituting the discharge valve mechanism 500A. In particular, positions and relative arrangements of a first through hole 545A (only FIG. 6 is illustrated) and a second through hole (only FIG. 7 is illustrated) provided in the discharge valve holder 54A are different.

Specifically, the discharge valve seat 51A includes a tubular seat body portion 511 whose internal space forms a primary-side flow path 511*a* of fuel, and an annular flange portion 512A integrally provided on one side (right side in FIGS. 6 and 7) in the axial direction of the seat body portion 511 and protruding radially outward. The discharge valve seat 51A has a seat surface 511*b* at the opening edge of the primary-side flow path 511*a* on the flange portion 512A side of the seat body portion 511. The discharge valve seat 51A is disposed such that the flange portion 512A side faces the valve body 52 side, and is fixed to the pump body 1*a* by press-fitting an outer peripheral surface on the distal end portion side of the seat body portion 511 into an inner peripheral surface of the discharge flow path 2*f* on the pressurizing chamber 3 side.

The discharge valve holder 54A is formed by integrally forming, in order from the opening side toward the bottom side, a first tubular portion 541A abutting on the end surface of the flange portion 512A of the discharge valve seat 51A, a second tubular portion 542 having a structure similar to that of the first embodiment in which the guide portion 542*a* and the stopper portion 542*b* are formed and the valve body 52 is held inside, and a bottomed third tubular portion 543 having a spring chamber 543*a* and a protruding portion 543*c* and having a structure similar to that of the first embodiment. The first tubular portion 541A (the portion of the second tubular portion 542 from the guide portion 542*a* side toward the discharge valve seat 51A side) has an inner diameter enlarged portion (inner peripheral surface) 541*b* formed such that the inner diameter gradually increases from the guide portion 542*a* side toward the discharge valve seat 51A side (toward the distal end side). The inner diameter enlarged portion 541*b* forms an internal space 541*a* and is continuous with the guide portion 542*a*.

As illustrated in FIG. 6, the first through hole 545A is formed at a position from a portion of the first tubular portion 541A closer to the second tubular portion 542 to a portion of the guide portion 542*a* of the second tubular portion 542. That is, the first through hole 545A opens in a part of the inner diameter enlarged portion 541*b* of the first tubular portion 541A and a part of the guide portion 542*a* of the second tubular portion 542. The first through hole 545A constitutes a first secondary-side flow path that causes the internal space 541*a* of the first tubular portion 541 located on the upstream side of the guide portion 542*a* and the internal space formed at the position of the guide portion 542*a* to communicate with the discharge flow path 2*g*, and causes the fuel to flow out to the side (radially outside of the discharge valve holder 54A) in the moving direction of the valve body 52.

As illustrated in FIG. 7, the second through hole 546A is formed at the position of the stopper portion 542*b* in the second tubular portion 542. That is, the second through hole 546A penetrates the discharge valve holder 54A in the radial direction at a position farther from the discharge valve seat 51A than the first through hole 545A, and is opened to the stopper portion 542*b* of the second tubular portion 542. The second through hole 546A constitutes a second secondary-side flow path that allows the internal space formed at the position of the stopper portion 542*b* on the downstream side of the guide portion 542*a* to communicate with the discharge flow path 2*g*, and allows the fuel to flow out to the side (radially outside of the discharge valve holder 54A) in the moving direction of the valve body 52.

As illustrated in FIG. 8, a plurality of (four in FIG. 8) first through holes 545A are formed at intervals in the circumferential direction of the discharge valve holder 54A. For example, the first through holes 545A are all formed to have the same hole diameter. A plurality of (four in FIG. 8) second through holes 546A are formed at intervals in the circumferential direction of the discharge valve holder 54A. For example, the second through holes 546A are all formed to have the same hole diameter. The plurality of first through holes 545A and the plurality of second through holes 546A are arranged so as to alternate positions in the circumferential direction (In FIG. 8, they are shifted by 45° from each other.), and are arranged at positions closer to each other in the axial direction than in the case of the first embodiment. The discharge valve holder 54A having such a configuration can have a length shorter than that of the discharge valve holder 54 of the first embodiment.

Next, the operation and action of the discharge valve mechanism according to the second embodiment of the present invention will be described with reference to FIGS. 6 and 7. In FIGS. 6 and 7, thick arrows L1, L2, L3, and L4 indicate the flows of fuel, respectively.

In the discharge valve mechanism 500A illustrated in FIGS. 6 and 7, when the valve body 52 is opened, the fuel passes through the gap between the valve body 52 and the opening portion of the discharge valve seat 51A and flows into the internal space 541*a* of the first tubular portion 541 of the discharge valve holder 54A (see flow L1). As illustrated in FIG. 6, a part of the fuel flowing into the internal space 541*a* of the first tubular portion 541 passes through the first through hole 545A of the discharge valve holder 54A and flows into the annular flow path 57 (see flow L2). Meanwhile, as shown in FIG. 7, the rest of the fuel passes through the gap between the guide portion 542*a* of the discharge valve holder 54A and the outer surface of the valve body 52, and then flows into the annular flow path 57 via the second through hole 546A (see flow L3). As shown in FIGS. 6 and 7, the fuel flowing into the annular flow path 57 through the first through hole 545A and the second through hole 546A merges, passes through the discharge flow path 2*g*, and flows toward the fuel discharge port 2*h* (see FIG. 3) (see L4).

As in the first embodiment, as illustrated in FIG. 7, when the fuel passes through the gap between the guide portion 542*a* of the discharge valve holder 54A and the outer surface of the valve body 52 at the start of opening of the valve body 52, the gap functions as a flow throttle. Therefore, the pressure of the fuel flowing into the second through hole 546A is lower than that of the fuel in the internal space 541*a* of the first tubular portion 541A. Therefore, the pressure in the spring chamber 543*a* connected to the internal space formed at the position of the stopper portion 542*b* where the second through hole 546A is opened is lower than the pressure in the internal space 541*a* of the first tubular portion 541A. Therefore, since a further pressure difference occurs before and after the valve body 52 in the moving direction, the force in the lift direction acting on the valve body 52 increases. As a result, since the valve opening speed (lift speed) of the valve body 52 increases, the responsiveness when the valve body 52 is opened is improved.

However, as illustrated in FIG. 6, since the first through hole 545A is opened in a part of the guide portion 542*a*, the effect of throttling the flow by the gap between the guide portion 542*a* and the outer surface of the valve body 52 is smaller than that in the case of the first embodiment. That is, the pressure drop of the fuel that has passed through the gap decreases, and the fuel differential pressure decreases before and after in the moving direction of the valve body 52 accordingly.

In this regard, in the present embodiment, as shown in FIG. 8, the plurality of first through holes 545A and the plurality of second through holes 546A are arranged so as to be alternately positioned in the circumferential direction. Therefore, as illustrated in FIG. 7, since the first through hole 545A is not disposed in the middle of the flow (see L3) traveling from the gap between the guide portion 542*a* and the outer surface of the valve body 52 to the second through hole 546A at the shortest distance, it is possible to suppress a decrease in the effect of throttling the flow due to the gap.

In the present embodiment, as shown in FIGS. 6 and 7, the first tubular portion 541A of the discharge valve holder 54A is formed with an inner diameter enlarged portion 541*b* that gradually increases in diameter from the guide portion 542*a* side toward the discharge valve seat 51A side. In this configuration, when the fuel flows into the internal space 541*a* of the first tubular portion 541 formed by the inner diameter enlarged portion 541*b* (see flow L1), in addition to the flow of the fuel toward the first through hole 545A or the guide portion 542*a*, a part of the flow of the fuel stagnates in the internal space 541*a* of the first tubular portion 541 due to the shape of the inner diameter enlarged portion 541*b*.

Since the flow velocity of the fuel stagnating in the internal space 541*a* of the first tubular portion 541 greatly decreases, the pressure increases accordingly. That is, the pressure in the internal space 541*a* of the first tubular portion 541 increases. Therefore, since a further pressure difference occurs before and after the valve body 52 in the moving direction, the force in the lift direction acting on the valve body 52 increases. As a result, since the valve opening speed (lift speed) of the valve body 52 increases, the responsiveness when the valve body 52 is opened is improved.

In addition, the fuel that has flowed into the annular flow path 57 through the first through hole 545A and the second through hole 546A and joined forms a high-speed swirl flow in the annular flow path 57 as in the first embodiment, so that a pressure drop occurs accordingly. In this case, since the influence of the pressure drop of the annular flow path 57 reaches the spring chamber 543*a* via the second through hole 546A, the pressure of the spring chamber 543*a* is further reduced. Therefore, since a further pressure difference occurs before and after the valve body 52 in the moving direction, the force in the lift direction acting on the valve body 52 increases. As a result, since the valve opening speed (lift speed) of the valve body 52 increases, the responsiveness when the valve body 52 is opened is improved.

As described above, the discharge valve mechanism 500A according to the second embodiment of the present invention includes the discharge valve seat (valve seat portion) 51A having the primary-side flow path 511*a*, the valve body 52 capable of seating on and separating from the discharge valve seat (valve seat portion) 51A, and the guide portion 542*a* that is formed to be slidable on the outer surface of the valve body 52 and guides the movement of the valve body 52 in the contacting/separating direction with respect to the discharge valve seat (valve seat portion) 51A. The guide portion 542*a* includes a portion in which a gap from the outer surface of the valve body 52 is set to a predetermined value or less. The first through hole 545A as the first secondary-side flow path that allows the internal space 541*a* on the upstream side of the guide portion 542*a* and the internal space formed at the position of the guide portion 542*a* to communicate with the discharge flow path (external flow path) 2*g* is formed so as to allow the fluid to flow out to the side in the moving direction of the valve body 52, and the second through hole 546A as the second secondary-side flow path that allows the internal space on the downstream side of the guide portion 542*a* to communicate with the discharge flow path (external flow path) 2*g* is formed so as to allow the fluid to flow out to the side in the moving direction of the valve body 52.

According to this configuration, since the guide portion 542*a* functions as a flow throttle to cause a pressure drop of the fluid, the fluid differential pressure between the front and rear internal spaces (the internal space 541*a* on the upstream side of the guide portion 542*a* and the internal space 543*a* on the downstream side) in the moving direction of the valve body 52 further increases accordingly. Therefore, since the valve opening operation of the valve body 52 becomes faster due to the increased fluid differential pressure, the responsiveness at the time of valve opening of the discharge valve mechanism 500A can be improved.

Further, the discharge valve mechanism 500A according to the present embodiment further includes the stopper portion 542*b* that is formed so as to be able to abut on the outer surface of the valve body 52 and regulates the movement of the valve body 52 in the lift direction, the stopper portion 542*b* is formed on the downstream side of the guide portion 542*b*, and the second through hole 546A (second secondary-side flow path) is formed to allow the internal space formed at the position of the stopper portion 542*b* to communicate with the discharge flow path (external flow path) 2*g*. According to this configuration, since the axial positions of the first through hole 545A and the second through hole 546A are closer than those in the first embodiment, the axial length of the discharge valve holder 54A can be shortened.

Further, in the discharge valve mechanism 500A according to the present embodiment, a tubular discharge valve holder (valve holder) 54A that holds the valve body 52 therein is provided, the first secondary-side flow path is constituted by the first through hole 545A that penetrates the discharge valve holder (valve holder) 54A in the radial direction, the second secondary-side flow path is constituted by the second through hole 546A that penetrates the discharge valve holder (valve holder) 54A in the radial direction at a position farther from the discharge valve seat (valve seat portion) 51A side than the first through hole 545A, and the plurality of the first through holes 545A and the plurality of the second through holes 546A are formed at intervals in the circumferential direction of the discharge valve holder (valve holder) 54A, and the first through hole 545A and the second through hole 546A are disposed such that their positions in the circumferential direction do not overlap each other. According to this configuration, since the first through hole 545A is not disposed in the middle of the flow (see L3) from the gap between the guide portion 542*a* and the outer surface of the valve body 52 toward the second through hole 546A, it is possible to suppress a decrease in the effect of throttling the flow due to the gap.

In addition, the discharge valve mechanism 500A according to the present embodiment includes a tubular discharge valve holder (valve holder) 54A that holds the valve body 52 therein and is formed with a guide portion 542*a*, in which the discharge valve holder (valve holder) 54A has the inner diameter enlarged portion 541*b* formed such that an inner diameter of a portion (first tubular portion 541) from the guide portion 542*a* side toward the discharge valve seat (valve seat portion) 51A side gradually increases toward the discharge valve seat (valve seat portion) 51A side, and a part of the first through hole (first secondary-side flow path) 545A opens to the inner peripheral surface of the inner diameter enlarged portion 541*b* of the discharge valve holder (valve holder) 54A. According to this configuration, since a part of the fuel flowing into the internal space 541*a* formed by the inner diameter enlarged portion 541*b* on the upstream side of the guide portion 542*a* stagnates in the internal space 541*a* due to the shape of the inner diameter enlarged portion 541*b* reduced in diameter with respect to the fuel flow direction, the flow velocity greatly decreases, and the pressure increases accordingly. Therefore, since a further pressure difference occurs before and after the moving direction of the valve body 52, the responsiveness when the valve body 52 is opened can be improved.

Note that the present invention is not limited to the above-described embodiments, and includes various modifications. The above-described embodiments have been described in detail for easy understanding of the present invention, and are not necessarily limited to those having all the described configurations. A part of the configuration of one embodiment can be replaced with the configuration of another embodiment, and the configuration of another embodiment can be added to the configuration of one embodiment. In addition, it is also possible to add, delete, and replace other configurations for a part of the configuration of each embodiment.

For example, in the first and second embodiments described above, the example of the configuration in which the discharge valve mechanism 500 includes the discharge valve spring 53 has been described, but the discharge valve mechanism may have a configuration in which the discharge valve spring 53 is omitted. However, the discharge valve mechanism 500 including the discharge valve spring 53 can obtain a more stable valve body operation.

In the first embodiment described above, the example of the configuration in which the outer peripheral surface of the distal end portion (first tubular portion) of the discharge valve holder 54 is fitted to the inner peripheral surface of the second attachment hole 1*g* has been described. However, it is also possible to adopt a structure in which the outer peripheral surface of the seat body portion 511 of the discharge valve seat 51 is press-fitted into the inner peripheral surface of the distal end portion (first tubular portion 541) of the discharge valve holder 54. In this case, the members 51, 52, 53, and 54 constituting the discharge valve mechanism 500 can be made into sub-assemblies. Accordingly, the assemblability of the discharge valve mechanism 500 is further improved.

In the first and second embodiments described above, the plug 55 and the discharge valve mechanism 500 are separately inserted into the second attachment hole. However, a configuration in which the plug 55 is press-fitted into the discharge valve holder 54 to form a subassembly is also possible. In this case, the assemblability of the discharge valve mechanism 500 is further improved.

In the first and second embodiments described above, the hole diameters of the first through hole 545 and the second through hole 546 are the same, but the hole diameters of the first through hole 545 and the second through hole 546 can be appropriately changed according to the pump flow rate. In addition, the number and circumferential positions of the first through holes 545 and the second through holes 546 provided in the discharge valve holder 54 can also be appropriately changed according to the pump flow rate.

In the present embodiment described above, the example has been described in which the electromagnetic suction valve mechanism 300 is configured by a normally open solenoid valve. However, as long as the suction valve mechanism is a solenoid valve that can be electromagnetically opened and closed, the influence on the low pressure portion of the high-pressure fuel supply pump is substantially the same, and thus, there is no influence on the application of the discharge valve structure of the present application.

REFERENCE SIGNS LIST

1 high-pressure fuel supply pump
51, 51A discharge valve seat (valve seat portion)
52 valve body
54 discharge valve holder (valve holder)
57 annular flow path
500, 500A discharge valve mechanism
541*a* internal space
541*b* inner diameter enlarged portion
542*a* guide portion
542*b* stopper portion
545, 545A first through hole (first secondary-side flow path)
546, 546A second through hole (second secondary-side flow path)

The invention claimed is:

1. A discharge valve mechanism comprising:
a valve seat portion which has a primary-side flow path;
a valve body which seats on and separates from the valve seat portion;
a guide portion which is formed so as to be slidable on an outer surface of the valve body and guides movement of the valve body in a contacting/separating direction with respect to the valve seat portion,
wherein the guide portion includes a portion in which a gap from an outer surface of the valve body is set to a predetermined value or less,
a first secondary-side flow path which allows an internal space on an upstream side of the guide portion to communicate with an external flow path is formed so as to allow a fluid to flow out to a side in a moving direction of the valve body, and
a second secondary-side flow path which allows an internal space on a downstream side of the guide portion to communicate with the external flow path is formed so as to allow a fluid to flow out to the side in the moving direction of the valve body; and
a stopper portion which is formed to abut on the outer surface of the valve body and regulates a movement of the valve body in a lift direction,
wherein the stopper portion is formed at a position between the guide portion and the second secondary-side flow path.

2. The discharge valve mechanism according to claim 1, further comprising a tubular valve holder which holds the valve body inside the valve holder and in which the guide portion is formed.

3. The discharge valve mechanism according to claim 2,
wherein the first secondary-side flow path includes a first through hole which penetrates the valve holder in a radial direction at a position closer to the valve seat portion than the guide portion, and
the second secondary-side flow path includes a second through hole which penetrates the valve holder in the radial direction at a position farther from the valve seat portion than the guide portion.

4. The discharge valve mechanism according to claim 3,
wherein an annular flow path is formed radially outside the valve holder, and
each of the first through hole and the second through hole opens to the annular flow path.

5. The discharge valve mechanism according to claim 3,
wherein a plurality of the first through holes are formed in a circumferential direction of the valve holder, and
all the first through holes have the same hole diameter.

6. The discharge valve mechanism according to claim 3, wherein a plurality of the second through holes are formed in a circumferential direction of the valve holder, and all the second through holes have the same hole diameter.

7. The discharge valve mechanism according to claim 3, wherein the first through hole and the second through hole are formed to have the same hole diameter.

8. The discharge valve mechanism according to claim 3, wherein a hole diameter of the first through hole is set to be equal to or more than a hole diameter of the second through hole.

9. A discharge valve mechanism comprising:

a valve seat portion which has a primary-side flow path;

a valve body which seats on and separates from the valve seat portion;

a guide portion which is formed so as to be slidable on an outer surface of the valve body and guides movement of the valve body in a contacting/separating direction with respect to the valve seat portion, wherein the guide portion includes a portion in which a gap from an outer surface of the valve body is set to a predetermined value or less, and a first secondary-side flow path that allows a space on an upstream side of the guide portion and an internal space formed at a position of the guide portion to communicate with an external flow path is formed so as to allow a fluid to flow out to a side in a moving direction of the valve body, and a second secondary-side flow path that allows an internal space on a downstream side of the guide portion to communicate with the external flow path is formed so as to allow a fluid to flow out to the side in the moving direction of the valve body; and a stopper portion which is formed to abut on an outer surface of the valve body and regulates movement of the valve body in a lift direction, wherein the stopper portion is formed on a downstream side of the guide portion, and the second secondary-side flow path is formed to allow an internal space formed at a position of the stopper portion to communicate with the external flow path.

10. The discharge valve mechanism according to claim 9, further comprising a tubular valve holder which holds the valve body inside the valve holder, wherein the first secondary-side flow path includes a first through hole which penetrates the valve holder in a radial direction, the second secondary-side flow path includes a second through hole which penetrates the valve holder in the radial direction at a position farther from the valve seat portion side than the first through hole, a plurality of the first through holes and a plurality of the second through holes are formed at intervals in a circumferential direction of the valve holder, and the first through hole and the second through hole are disposed such that circumferential positions of the first through hole and the second through hole do not overlap each other.

11. The discharge valve mechanism according to claim 9, further comprising a tubular valve holder which holds the valve body inside the valve holder and in which the guide portion is formed, wherein the valve holder includes an inner diameter enlarged portion formed such that an inner diameter of a portion from the guide portion side toward the valve seat portion side gradually increases toward the valve seat portion side, and a part of the first secondary-side flow path opens to an inner peripheral surface of the inner diameter enlarged portion of the valve holder.

12. A high-pressure fuel supply pump comprising the discharge valve mechanism according to claim 1.

13. A high-pressure fuel supply pump comprising the discharge valve mechanism according to claim 9.

* * * * *